US008333681B2

(12) United States Patent
Schmidt

(10) Patent No.: US 8,333,681 B2
(45) **Date of Patent: *Dec. 18, 2012**

(54) SPEED CONTROLLED STRENGTH MACHINE

(76) Inventor: David H. Schmidt, Darien, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/648,531

(22) Filed: Dec. 29, 2009

(65) Prior Publication Data

US 2010/0144496 A1 Jun. 10, 2010

Related U.S. Application Data

(63) Continuation-in-part of application No. 12/420,928, filed on Apr. 9, 2009, now Pat. No. 7,641,597, which is a continuation of application No. 10/685,625, filed on Oct. 15, 2003, now Pat. No. 7,179,205, and a continuation-in-part of application No. 09/977,123, filed on Oct. 12, 2001, now Pat. No. 6,835,167, which is a continuation of application No. 08/865,235, filed on May 29, 1997, now Pat. No. 6,302,829.

(60) Provisional application No. 60/418,461, filed on Oct. 15, 2002, provisional application No. 60/018,755, filed on May 31, 1996.

(51) Int. Cl.
*A63B 24/00* (2006.01)
*A63B 69/18* (2006.01)

(52) U.S. Cl. ..... 482/51; 482/70; 482/4

(58) Field of Classification Search ..... 482/51, 482/70, 52, 53, 54, 1–9, 57–65
See application file for complete search history.

(56) References Cited

U.S. PATENT DOCUMENTS

| | | | | |
|---|---|---|---|---|
| 208,954 | A | | 10/1878 | Bryon |
| 3,941,377 | A | | 3/1976 | Lie |
| 4,204,673 | A | | 5/1980 | Speer, Sr. |
| 4,326,707 | A | * | 4/1982 | Strecker ..... 482/113 |
| 4,357,010 | A | * | 11/1982 | Telle ..... 482/97 |
| 4,607,841 | A | * | 8/1986 | Gala ..... 482/91 |
| 4,625,962 | A | * | 12/1986 | Street ..... 482/116 |
| 4,645,205 | A | * | 2/1987 | Wolff ..... 482/139 |
| 4,673,177 | A | | 6/1987 | Szymski |
| 4,674,741 | A | * | 6/1987 | Pasierb et al. ..... 482/72 |
| 4,822,036 | A | * | 4/1989 | Dang ..... 482/6 |
| 4,830,363 | A | * | 5/1989 | Kennedy ..... 482/56 |
| 4,867,443 | A | | 9/1989 | Jensen |
| 4,869,498 | A | * | 9/1989 | Wolf et al. ..... 482/113 |
| 4,880,224 | A | | 11/1989 | Jonas et al. |
| 4,900,013 | A | | 2/1990 | Rodgers, Jr. |
| 4,960,276 | A | | 10/1990 | Feuer et al. |

(Continued)

OTHER PUBLICATIONS

Wang, Yu, et al.; A True Bicycle Simulator, Design Research Centre, Apr. 3, 2002; http://www.drc.ntu.edu.sg/groups/drc_www/projects_vr/bicycle_simulator/enter.epl; (22 pages).

(Continued)

*Primary Examiner* — Stephen Crow
(74) *Attorney, Agent, or Firm* — Eugene M. Cummings, P.C.

(57) ABSTRACT

A speed controlled strength machine is provided. The machine includes a frame and a number of support members. A driver is mounted to the frame and includes an adjustable speed controller. During exercise, the user engages grips/handles and pulls them via one-way clutches through the resistive movement of the driver. The clutches are engaged when the user is able to reach a predetermined speed, which is adjustable and controllable.

35 Claims, 23 Drawing Sheets

U.S. PATENT DOCUMENTS

| | | | | |
|---|---|---|---|---|
| 5,029,848 | A * | 7/1991 | Sleamaker | 482/96 |
| 5,158,513 | A * | 10/1992 | Reeves | 482/56 |
| 5,192,257 | A | 3/1993 | Panasewicz | |
| 5,224,909 | A * | 7/1993 | Hamilton | 482/70 |
| 5,277,678 | A | 1/1994 | Friedebach et al. | |
| 5,328,422 | A | 7/1994 | Nichols | |
| 5,368,533 | A | 11/1994 | Feuer et al. | |
| 5,407,409 | A | 4/1995 | Tang | |
| 5,429,567 | A | 7/1995 | Gerschefske et al. | |
| 5,435,798 | A * | 7/1995 | Habing et al. | 482/5 |
| 5,449,336 | A | 9/1995 | Sabel | |
| 5,792,026 | A | 8/1998 | Maresh et al. | |
| 5,792,029 | A | 8/1998 | Gordon | |
| 6,016,002 | A | 1/2000 | Chen et al. | |
| 6,106,436 | A * | 8/2000 | Lundahl | 482/1 |
| 6,267,709 | B1 * | 7/2001 | Jacques et al. | 482/8 |
| 6,302,829 | B1 * | 10/2001 | Schmidt | 482/70 |
| 6,328,677 | B1 * | 12/2001 | Drapeau | 482/72 |
| 6,355,959 | B1 | 3/2002 | Vashchenko et al. | |
| 6,433,368 | B1 | 8/2002 | Vashchenko et al. | |
| 6,541,801 | B1 | 4/2003 | Vashchenko et al. | |
| 6,569,065 | B1 * | 5/2003 | Menold et al. | 482/72 |
| 6,626,802 | B1 * | 9/2003 | Rodgers, Jr. | 482/51 |
| 6,790,163 | B1 * | 9/2004 | Van De Laarschot et al. | 482/56 |
| 6,835,167 | B2 * | 12/2004 | Schmidt | 482/70 |
| 6,855,093 | B2 | 2/2005 | Anderson et al. | |
| 6,929,587 | B2 * | 8/2005 | Charnitski | 482/110 |
| 7,204,790 | B2 * | 4/2007 | Sleamaker | 482/96 |
| 7,335,143 | B2 * | 2/2008 | Lundahl | 482/110 |
| 7,524,272 | B2 * | 4/2009 | Bruck et al. | 482/127 |
| 7,591,764 | B2 * | 9/2009 | Zuckerman | 482/56 |
| 7,824,310 | B1 * | 11/2010 | Shea | 482/9 |
| 2004/0217425 | A1 | 11/2004 | Brodsky et al. | |
| 2010/0298097 | A1 * | 11/2010 | Preumont et al. | 482/5 |

OTHER PUBLICATIONS

Affordable Isokinetic Testing & Treatment; Mini-Gym Company, 4141 NE Port Drive, Lee's Summit, MO 64064; MINI-GYM.COM; (2 pages).

* cited by examiner

Fig. 9
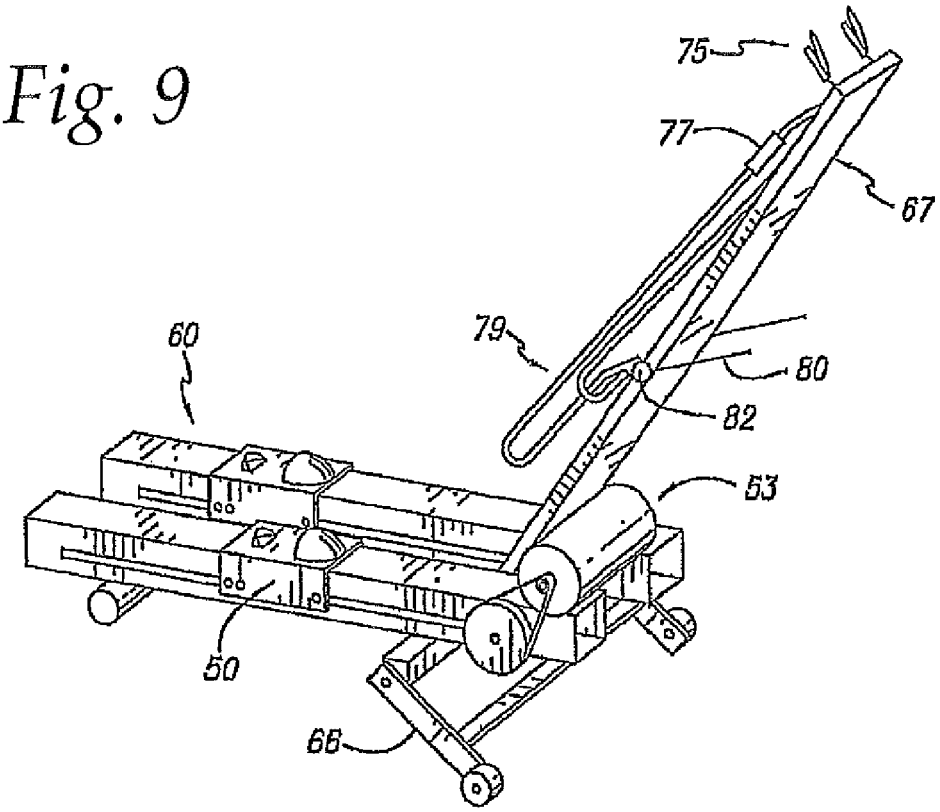
Fig. 10
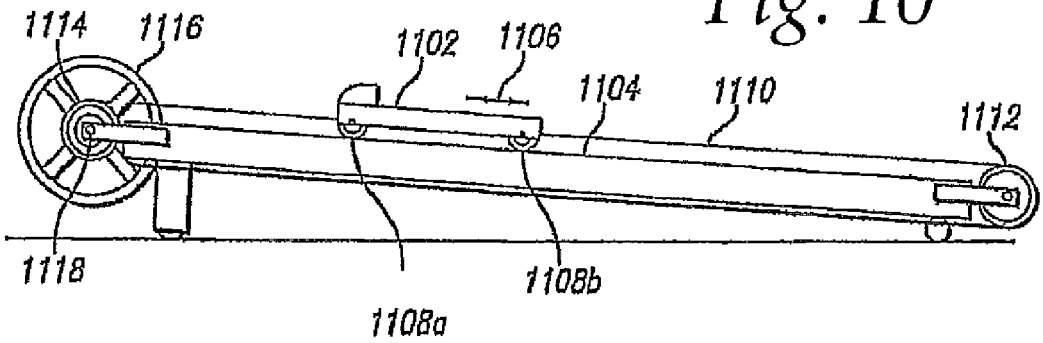
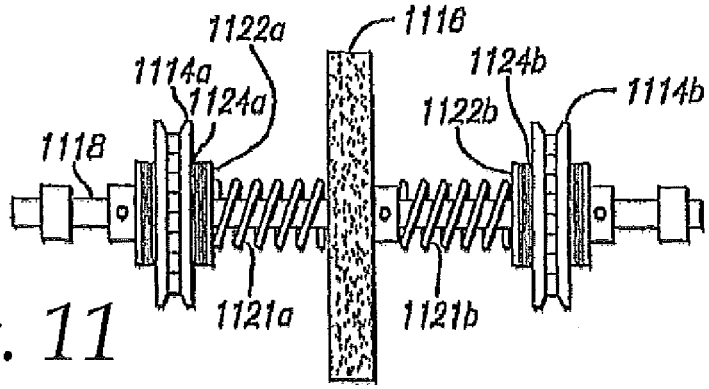
Fig. 11

SPEED CONTROLLED STRENGTH MACHINE

CROSS-REFERENCE TO RELATED APPLICATIONS

This application claims benefit as a continuation-in-part of application Ser. No. 12/420,928, filed Apr. 9, 2009 now U.S. Pat. No. 7,641,597, which claims benefit as a continuation of application Ser. No. 10/685,625 filed Oct. 15, 2003, now U.S. Pat. No. 7,179,205, which claims benefit under: (i) 35 U.S.C. 119(e) of U.S. Provisional Application, Ser. No. 60/418,461 filed Oct. 15, 2002; and (ii) as a Continuation-In-Part of application Ser. No. 09/977,123 filed Oct. 12, 2001, now U.S. Pat. No. 6,835,167, which is a continuation of application Ser. No. 08/865,235 filed May 29, 1997, now U.S. Pat. No. 6,302, 829, which claims benefit of application Ser. No. 60/018,755 filed May 31, 1996.

BACKGROUND OF THE INVENTION

The present invention relates to an apparatus for performing exercise and a method for using such apparatus and in particular to an apparatus which closely simulates many natural forms of exercise such as cross-country skiing, walking, running, biking, climbing and the like. The present invention further relates to an apparatus for replicating the reciprocating nature of motion during exercise, and more particularly to an apparatus for exercise, rehabilitation, amusement, and/or simulation of human-powered motion. The present invention further relates to an apparatus for strength training and in particular to an apparatus which addresses the natural physiology of the human body.

Many forms of natural exercise (i.e., exercise performed without the use of a stationary exercise machine) provide numerous benefits to an exerciser. In a number of types of natural exercise, a bilateral motion is performed of such a nature that in addition to the work done by a muscle group on one side of the body used, e.g., to attain forward motion in a motive type of exercise, there is simultaneously some amount of resistance to the muscle groups on the other side of the body, typically opposing types of muscle groups, so that both extension and flexion muscle groups are exercised. In a typical bilateral exercise such as cross-country skiing, the exerciser utilizes gluteus maximus and hamstring muscles in the backward stroke and, simultaneously, on the opposite side, quadriceps and hip flexor muscles in the forward stroke. Although various attempts have been made to simulate cross-country ski exercise or other bilateral exercise on a stationary exercise machine, these attempts have not been fully successful in reproducing the experience with sufficient accuracy to provide many of the health benefits of natural exercise. For example, in some ski-type exercise devices, while the trailing limb encounters resistance, the opposite limb encounters virtually no resistance (typically only resistance from fiction of moving machine parts). As a result, many such previous devices include a feature intended to counteract the force of the backward thrusting limb, such as an abdomen pad which receives the forward thrust of the exerciser's body as the exerciser pushes backward against resistance with each leg in an alternating fashion. This abdominal pad keeps the user in a stationary fore/aft position. It is believed that in such (stationary) machines, pushing against the abdominal pad can lead to lower back stress and fatigue and detracts from an accurate simulation of the natural cross-country ski exercise. It is further believed that the lack of forward resistance and the associated lack of balance in such devices lead to a long learning curve such that, to successfully use the machine, a user must develop a new technique for walking or skiing which is very different from that found in nature.

Another feature of many natural bilateral exercises such as skiing, walking, running, jogging, bicycle riding, etc., is that while the exerciser may on average move forward at a constant velocity, the exerciser momentarily accelerates and decelerates as he begins and ends each stroke. As a result, in many natural bilateral exercises, although the exerciser maintains a constant average speed, in fact if one were to travel alongside the exerciser at such constant speed, the exerciser would appear to be oscillating forward and backward with respect to the observer. This constant change in velocity is natural to most forms of human propulsion by virtue of an alternating stride while walking, running, bicycling, etc.

Again, it is believed that many stationary exercise devices fail to reproduce this feature of the natural exercise with sufficient accuracy to provide an enjoyable exercise experience and to provide all the benefits available with natural exercise, such as a more natural and less stressful distribution of force on the joints and development of good balance. For example, with the above-described ski exercise machine, the exerciser is typically pushing against the abdominal pad during substantially most or all of the exercise, thus causing the exerciser to stay in substantially the same position rather than accelerate and decelerate in an oscillating manner as in natural skiing.

A number of forms of natural exercise provide benefits to the upper body as well as the lower body of the exerciser. For example, in cross-country skiing, the exerciser typically pushes using poles. A number of features of the upper body exercise in natural exercise settings are of interest in the context of the present invention. For example, during cross-country skiing, the arm and leg motions are related such that if a skier wishes to maintain constant average speed, exerting greater upper body effort ("poling" with the arms) results in less effort being exerted by the legs, and vice versa. Further, in cross-country skiing, although the arm and leg energy exertions are related, the left and right upper body exertions are independent in the sense that the user does not need to pole in an alternating fashion, much less a fashion which is necessarily synchronized with the leg motions. A cross-country skier may "double pole", i.e., pushing with both poles at the same time, or may, if desired, push with only a single pole or no poles for a period of time. Another feature of cross-country skiing is that while the skier is moving, when a pole is plunged into the snow, the pole engages a resistance medium which relative to the skier is already in motion, thus providing what may be termed "kinetic resistance".

Many types of previous exercise devices have failed to provide a completely satisfactory simulation of natural upper body exercise. For example, many previous ski devices provided only for dependent arm motion, i.e., such that the arms were essentially grasping opposite ends of the rope wound around a spindle. In such devices, as the left arm moved backward, the right arm was required to simultaneously move forward substantially the same amount. Thus it was impossible to accurately simulate double poling or poling with a single arm. Many previous devices provided upper body resistance that was entirely unrelated to lower body resistance. In such devices, if an exerciser was expending a given level of effort, by exerting greater upper body efforts, the user was not, thereby, permitted to correspondingly decrease lower body exercises while maintaining the same overall level of effort. Many previous devices having upper body resistance mechanisms provided what may be termed "static resistance" such that when the arm motion began, such as by thrusting or pushing, or pulling backward with one arm, the resistance device was being started up from a stopped position, typically making it necessary to overcome a coefficient of static friction and detracting from the type of kinetic or dynamic resistance experienced in the natural cross-country ski exercise.

Many types of exercise devices establish a speed or otherwise establish a level of user effort in such a fashion that the user must manually make an adjustment or operate a control in order to change the level of effort. Even when an exercise device has a microprocessor or other apparatus for automatically changing levels of effort, these changes are pre-programmed and the user cannot change the level of effort to a level different from the pre-programmed scheme without manually making an adjustment or providing an input to control during the exercise. For example, often a treadmill-style exercise machine is configured to operate at a predetermined level or series of pre-programmed levels, such that when the user wishes to depart from his or her predetermined level or series of levels, the user must make an adjustment or provide other input. In contrast, during natural exercise such as biking, the user may speed up, slow down, change gears, or rest at will.

Additionally, current human motion simulating machines such as exercise bikes, skiers, rowers, etc. have one very important aspect in common; they are considered stationary machines. In other words, the platform on which the user sits or stands is fixed in location. As discussed below, this stationary aspect prevents these devices from realistically exhibiting the sensation of natural motion.

When a person propels a bicycle, cross country skis, row boat, etc., there are subtle fore and aft motions encountered by both the person and the vehicle. Although the amplitude and duration of these motions are somewhat specific to a particular vehicle, they are all tied directly to the force output generated by the person propelling the vehicle. For example, when a person rides a bicycle, these subtle motions occur as a result of his pedaling, and the reciprocating action of the user's legs is what ultimately motivates the bicycle in a forward direction. When closely examining the physics behind the forward motion of a bicycle it becomes apparent that the bicycle and user are in a continual state of acceleration and deceleration while the user pedals. This is due to the fact that when the user exerts a force on one of the pedals, the bicycle and user accelerate until that pedal begins to approach the bottom of its stroke, at which point the bicycle and user begin to decelerate. As the opposite pedal reaches the top of its stroke, this cycle begins again. As a result, the cyclist is in a constant state of acceleration and deceleration. This oscillating motion can be easily witnessed by driving in a car at a constant speed along side a cyclist. From the perspective of an occupant of the car looking out a side window, the rider will appear to move fore and aft in a manner directly related to his pedaling cadence. This fore and aft movement will generally be between a range of one-half of an inch on level or downhill terrain to several inches on an uphill grade.

When a rider encounters a hill, he generally changes the gear ratio of his bike by "changing gears" such that a lower ratio is used. The rider can therefore maintain the same cadence and force output as he would on level ground resulting in a slower speed up hill. For example, it is the goal of a profession cyclist to maintain a relatively steady cadence, normally 80-100 strokes per minute. This is the case whether riding on level terrain, uphill or downhill. The use of a gearing system ensures that a constant cadence is maintained, even though the speed of the bicycle may vary drastically.

The use of a gearing system also affects the motion of the vehicle being ridden. For example, the fore and aft oscillation of a bicycle is much greater in low gear vs. high gear due to the increased torque applied to the drive wheel. As a result, in low gear there is much less stress on the leg joints and muscles. This is particularly important in physical therapy and rehabilitation. For example, a person recovering from reconstructive knee surgery may be advised by a physician to exercise the knee with very low exertion. In this case, it would be advantageous for the person to exercise on a bicycle in a low gear ratio to reduce stress on the recovering knee.

An important aspect of natural human motion is the concept of rest. For example, during the deceleration phase of the oscillation described above, the muscles experience a short period of rest. This rest period increases as the period of oscillation increases. When a rider pushes a pedal once every few seconds, the bicycle coasts during the rest periods.

Current exercise bicycles generally include a user seat on a frame with a set of pedals which spin a flywheel. The flywheel is magnetically or otherwise braked to give resistance to the user's legs. These machines generally simulate hill climbing by simply adding greater resistance to the flywheel which requires either a greater force output or slower pedaling cadence by the user and adds increased pressure to the legs and joints. The stationary nature of these machines precludes the user from experiencing the fore and aft motion encountered while using a real bicycle. Instead, although the user's body strains to oscillate forward and backward, the stationary aspect of the machine keeps him fixed in one place. This causes a jerky sensation which translates into an uncomfortable and non-motivating activity, as well as the potentially dangerous wear and tear on the user's joints and muscles.

The solid line in the chart of FIG. 13 depicts the force exerted by a user's foot on the pedal of an actual bicycle during a pedal stroke. From this chart, it becomes apparent that the forward acceleration of the bicycle and rider reduces the initial force exerted against the pedal when the knee is bent the most. This greatly reduces the stress to knee and leg muscles when compared to a stationary bike which requires the user's full force from the very beginning of the stroke. See the dashed line of FIG. 13.

Similar principles apply to the activity of natural rowing when compared to the use of a stationary rowing exercise machine. When rowing a boat with a sliding seat, the user straps his feet to a stationary part of the boat and sits on a seat facing rearward which can slide fore and aft. At the beginning of the stroke, the user bends his knees so as to bring his body toward the rear of the boat. He then extends his arms fully and engages the oar blades into the water. Next he straightens his legs and pulls the oars toward his torso. At the end of each stroke, the user pulls the oar blades out of the water and returns to the beginning of his stroke to start the sequence again.

As with the bicycle, a person following alongside a rower at a steady speed will observe the boat and user oscillating fore and aft with each stroke. As the user engages the oar blades and begins his stroke (the power stroke), the boat and user accelerate forward. When the user reaches the end of his stroke and returns (return stroke) to the starting position, the boat and user decelerate. Relative to the observer, this oscillation will be considerably greater than that of a bicycle, and, depending on the amount of time the user takes on his return stroke, may exceed one foot.

Most rowing exercise machines confine a user to a fixed location, i.e. the user's feet are strapped to a stationary pad. These designs don't allow for any fore and aft movement of the user's body other than the sliding of the seat. This results in a jerking sensation at the beginning and end of each stroke. These rowing machines can cause strain on the back and legs and over-compression of the knees. See FIG. 13.

These stationary exercise bike and rower examples demonstrate the need for a more realistic exercise machine capable of accurately replicating the forces of nature as they apply to human powered locomotion devices. The present invention overcomes the above-mentioned obstacles and can be applied to any type of exercise device which uses the reciprocating nature of human motion such as a bike machine, a rowing machine, a cross-country ski machine and any other reciprocating motion apparatus and the like. The present invention can be likened to a human propelled differential motion machine, much like the differential on an automobile. In particular, a dynamic element moves in one direction (input 1), the user mounts a carriage and motivates a drive wheel (or the like) in the opposite direction (input 2), and the user and carriage move based on the difference between the two inputs, or the differential.

Along with providing a more realistic machine for accurately replicating the forces of nature as they apply to cardiovascular exercise devices, the present invention also provides a similarly realistic machine for accurately maximizing strength exercise. Coupled with cardiovascular training, strength training is an important part of maintaining optimal physical fitness.

Strength training involves applying a force against a resistance over a range of motion. Human anatomy limits the amount of force a user can produce at any one position throughout this range, and the magnitude of force which can be safely applied at any point can vary considerably.

For example, when exercising the triceps muscles, a person begins with forearms flexed at the elbows (e.g. 45 degrees) and pushes against a resistance until the elbows are fully extended (e.g. 180 degrees). The lever arm at the elbow where the triceps attaches to the forearm is shorter during flexion than during extension. As a result, a person's force output capability increases as the forearm is extended. See FIG. 23. A functional triceps exercise would therefore apply a variable force, starting low at the beginning of the stroke and increasing throughout extension.

As such, some forms of strength training can feel unnatural and even cause injury. An injury can further complicate the optimal force which an individual can apply during the range of motion. For example a person with tendonitis of the elbow may feel the greatest discomfort halfway through the range of motion (e.g. 112.5 degrees). The optimal force output for this person might be 5 lbs at 45 degrees, 10 lbs at 72 degrees, 3 lbs at 99 degrees, 10 lbs at 126 degrees, 20 lbs at 153 degrees and 18 lbs at 180 degrees. See FIG. 24.

Lifting weights is one of the most popular forms of strength training This can involve lifting free weights, using linkages or cables attached to weights. Weight lifting involves lifting and lowering a fixed weight. The profile of the force application to the user is counterintuitive. For example, a weight bearing cable pull-down exercise performed for exercising the triceps generally involves running a cable over a pulley at head level and down to a fixed weight. The user grasps a handle on the other end of the cable, suspends the weight with elbows fully flexed, and then begins the motion of extending the upper arms downward until full extension is achieved. He then returns to the flexed position and repeats the move.

Assuming the use of a 25 lb. weight, the force applied to the user prior to beginning the move is 25 lbs. At this point the weight is hanging, but not moving. As soon as the user begins the motion, he has to accelerate the weight from a stopped position causing a brief impulse force (F=ma). This impulse force will generally range from 25% to 50% of the weight being used and its effect is added to the weight itself. Once the weight is up to speed, the force drops to 25 lbs., and as the user reaches the end of the stroke and decelerates the weight, there is a negative impulse force (force reduction). As a result, the user experiences a force of as much as 37.5 lbs. at his weakest position, and as little as 12.5 lbs. at his strongest position. See FIG. 25.

Spring resistance is another form of strength training. Using linkages or cables attached to springs, these machines allow users to exercise a variety of muscle groups. Spring loaded strength exercisers generally rely on winding a spring throughout the range of motion. In this case, the force application generally begins at some predetermined amount and then increases throughout the range of motion based on the spring constant. See FIG. 26.

Flywheel/resistance based machines, utilizing linkages or cables to allow the user to exercise, are yet another form of strength training. These machines can offer a complex variety of forces depending on speed and frequency repetition. These machines generally utilize a speed dependant resistance mechanism such that the faster the user pulls, the greater the resistance. The force application also includes a "tare" component necessary to power the device and keep the flywheel rotating. See FIG. 27.

Most strength training machines/techniques require a user to choose a weight or resistance based on the weakest point throughout his range of motion. This limits the effectiveness of the workout by not taxing the muscles enough during the stronger points throughout the range of motion.

Additionally it becomes "hit or miss" when trying to determine the maximum force a user can apply. For example, determining the maximum weight that can be bench pressed requires the user to try consecutively larger amounts until the weight cannot be lifted. Going through this process weakens the user with each consecutive try which makes the results unreliable.

The above mentioned forms of strength exercise cannot address the natural physiology of the human body. Additionally, the complex profile of the ideal force applied over the range of motion (functional strength training) not only varies from one exercise to another or one person to another, but from one repetition to another.

Accordingly, it would therefore be advantageous to utilize a strength exercise which allows the user to apply a varying force of his choosing throughout the range of motion.

It is a general objective of the present invention to provide a speed controlled strength machine such that resistance (torque) is user dependent.

It is another general object of the present invention to provide a strength exercise machine which allows a user to exercise in a functional manner with improved safety and effectiveness.

It is another object of the present invention to provide a strength exercise machine which allows a user to easily determine their maximum force output at any given time.

It is a more specific object of the present invention to provide a strength exercise machine which allows a user to vary the force output at any time throughout the range of motion.

Yet another object of the present invention is to provide a strength exercise machine which allows a user to alternate from one strength exercise to another without making any adjustments to the machine.

Yet another object of the present invention is to provide a strength exercise machine which allows the user to apply a different amount of force from limb to limb.

Yet another object of the present invention is to provide a strength exercise machine which allows the user to exercise at various speeds.

Another object of the present invention is to provide a strength training exercise machine which displays the amount of force being produced by the user at any point throughout the range of motion.

Another object of the present invention is to provide a strength exercise machine which displays a workout regimen to coach the user from one strength exercise to the next.

Yet another object of the present invention is to provide a strength exercise machine which allows opposing muscle groups to be exercised simultaneously.

Another object of the present invention is to provide a strength exercise machine which displays speed of motion, number of repetitions and range of motion.

These and other objects, features and advantages of the present invention will be clearly understood through a consideration of the following detailed description.

SUMMARY OF THE INVENTION

An exercise apparatus is provided including a frame. A driver is mounted to the frame and includes an adjustable speed controller for controlling a constant predetermined speed. User engageable grips are attached to the driver through one-way clutches such that the clutches engage the driver when the user reaches the predetermined speed through use of the grip during exercise.

BRIEF DESCRIPTION OF THE DRAWINGS

The features of the present invention, which are believed to be novel, are set forth with particularity in the appended claims. The invention, together with the further objects and advantages thereof, may best be understood by reference to the following description taken in conjunction with the accompanying drawings, in the several figures of which like reference numerals identify like elements, and in which:

FIG. 9 is a perspective view of an exercise device according to an embodiment of the present invention;

FIG. 10 is a flowchart depicting a procedure for speed control of an exercise device according to an embodiment of the present invention; and FIGS. 11 and 12 are side and partial top views illustrating an exercise device according to an embodiment of the present invention.

DESCRIPTION OF THE PREFERRED EMBODIMENTS

Figure 1:
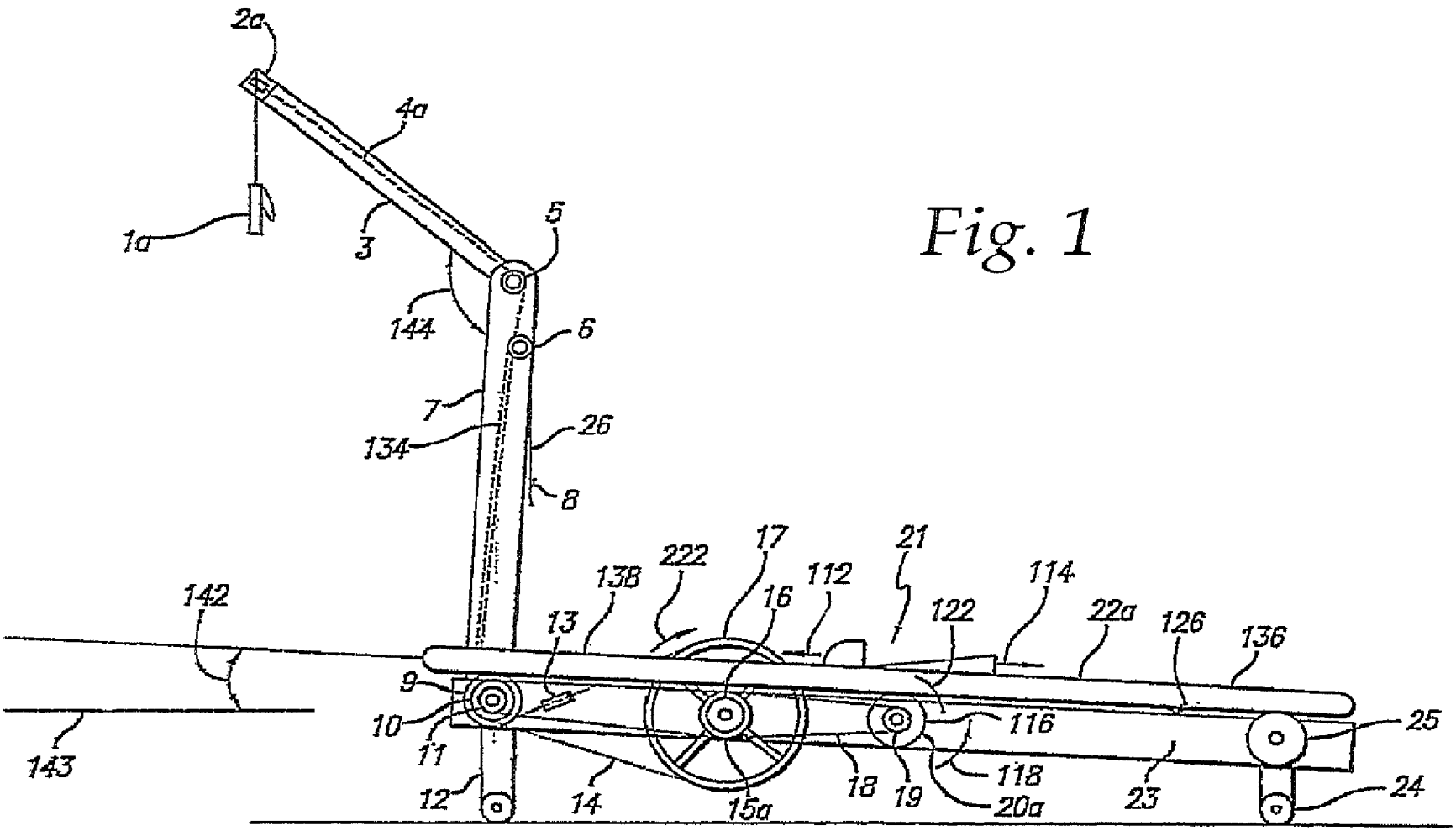
FIG. 1 depicts a side view of an apparatus according to one embodiment of the present invention.

As seen in FIG. 1, according to one embodiment, an exercise device includes a lower frame member, 23 supported by front and rear frame supports 12, 24. The frame members, support members and the like can be made of a number of materials, including metal, such as steel or aluminum, plastic, fiberglass, wood, reinforced and/or composite materials, ceramics and the like. Preferably the frame supports 12, 24 are coupled to the lower frame such that the lower frame can be inclined 142 at various angles. For example, the incline of the machine can be adjusted by providing front supports 12 with various adjustment mechanisms such as a rack-and-pinion adjustment, hole-and-pin adjustment, ratchet adjustment, and the like. The machine can be operated at an inclination 142 within any of a range of angles, such as between about 2 degrees and 45 degrees (or more) to the horizontal 143. Preferably, in the embodiment of FIG. 1, at least some upward inclination 142 is provided during use, e.g., sufficient to overcome internal friction of the device so as to position the user towards the rearmost position 136, while the user is not exercising.

Coupled to the frame on the left side thereof are front and rear idler wheels 9, 25, supporting a simulated ski 22 bearing a ski-type foot support 21, preferably having both toe and heel cups to permit the user to slide the simulated ski both in a forward direction and in a rearward direction against resistance, as described more fully below. The ski 22 can be made of a number of materials, including wood, fiberglass, metal, ceramic, resin, reinforced or composite materials. Preferably the ski 22 can be translated in a forward 112 or rear 114 direction while supported by idler wheels 9, 25. If desired, additional idler wheels can be provided and/or additional supports such as a low-friction support plate or rail, or a belt, cable, chain, or other device running between idler wheels 9, 25 can be used.

Figure 2:
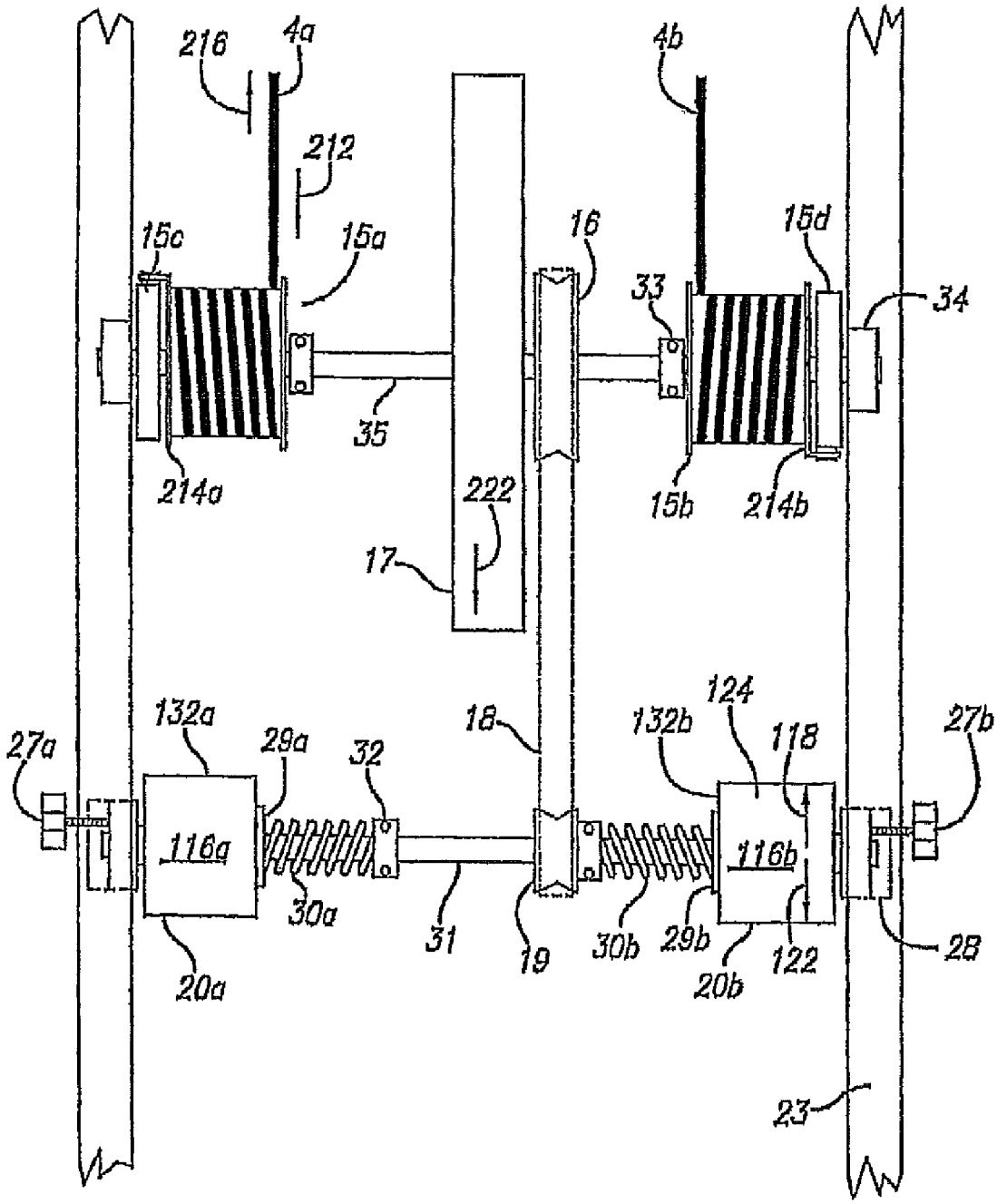
FIG. 2 is a top plan view (partial) of the apparatus of FIG. 1.

In the depicted embodiment the ski 22 is coupled to a roller 116 such that translation of the ski 22 in a forward direction 112 rotates the roller 116 in a first direction 118, and translation of the ski 22 in the opposite direction 114 rotates roller 116 in the opposite direction 122. Coupling to achieve such driven rotation of the roller 116 can be achieved in a number of fashions. For example, the roller's exterior cylindrical surface 124 and the bottom surface 126 of the ski 22 may be provided with high friction coatings. Teeth may be provided on the surfaces of the ski 22 and the roller 116 to drive the roller in a rack-and-pinion-like fashion. Ski 22 may be coupled to a line wrapper about the roller 116. Although in the view of FIG. 1, only a single (left) set of idler rollers 9, 25, driven roller 116 and ski 22 are depicted, a substantially identical set (not shown in FIG. 1) will be coupled on the opposite (right) side of the lower frame 23, some of which are shown in FIG. 2.

In the depicted embodiment, resistance to rearward movement 114 of the ski 22 is achieved by coupling the driven roller 116 so as to, in turn, drive a flywheel 17 which can be braked as described more fully below. As depicted in FIG. 2, in one embodiment the driven rollers 116*a*, 116*b* are the exterior surfaces of one-way clutches 20*a*, 20*b* configured such that when a ski 22*a* is moved in a forward direction 114 so as to drive the exterior surface in a first rotational direction 122, the corresponding one-way clutch 20*a* disengages so that the clutch overrides the driveshaft 31 and is essentially disengaged therefrom. The driveshaft 31 is rotationally mounted in driveshaft bearing 28 and shaft collars 32. A number of one-way clutch devices can be used, including a spring clutch, a plate clutch or a cam clutch. In one embodiment, a clutch of the type used in a NordicTrack™ exercise device (for a different purpose) is used. As seen in FIG. 2, each ski 22*a*, 22*b*, is coupled to the same type of one-way clutch 20*a*, 20*b*, for selectively driving the driveshaft 31. Accordingly, the driveshaft 31 will be driven in a first rotational direction 122 whenever either the left ski 22*b* or the right ski 22*a* drives the left driven roller 116*a* or the driven roller 116*b* in the rearward rotational direction 122.

In the depicted embodiment, the driveshaft 31 is coupled to a second shaft 35 via V-belt 18, running around sheaves 19, 16. Second shaft 35 is directly coupled to the flywheel 17. Thus, driving the driveshaft 31 results in rotation of the flywheel 17.

Because the flywheel, by virtue of its mass and effective radius (diameter) requires a substantial amount of energy to rotate, the flywheel creates a certain amount of resistance to rotation of the driven rollers and thus, the translation of skis 22*a*, 22*b*. Looked at in another way, and without wishing to be bound by any theory, it is believed the flywheel 17 resists the energy generated by the user in moving the skis rearwardly, causing the user's body to thrust forward. In the depicted embodiment, the speed of rotation of the flywheel can be controlled using mechanisms described more thoroughly below.

Preferably, resistance is also provided to rotation of the driven roller 116*a*, 116*b* in the opposite (forward) direction 118. Such resistance can be useful in more accurately simulating natural exercise, such as a resistance to forward-sliding of cross-country skis through snow. In the depicted embodiment, brake pads 29*a*, 29*b* are urged against the inner faces of the one-way clutches 20*a*, 20*b*, e.g., by brake springs 30*a*, 30*b*. Preferably the brake pad 29 is coupled to the driveshaft 31 so as to rotate therewith. Accordingly, when a ski 22 is moved in the rearward direction 114 and the corresponding one-way clutch 20*a* is engaged with driveshaft 31, the brake pad 29*a* rotates with the inner face 132*a* of the one-way clutch 20*a* so that substantially no friction braking of the one-way clutch 20*a* or driven roller 116*a* occurs. However, when the ski 22*a* is moved in the forward direction 112 so that the driven roller 116*a* is rotated in the forward rotational direction 118 and the one-way clutch is disengaged, the roller 116*a* and brake pad 29 are rotating in opposite directions 118, 122 respectively so that friction braking of the driven roller 116*a* occurs, providing frictional resistance to forward motion of the ski 22*a*.

In the depicted embodiment, a screw adjustment 27 is provided for adjusting the amount of friction (i.e., the pressure) of the brake pads 29*a*, 29*b* against the inner faces 132*a*, 132*b* of the rollers 116*a*, 116*b*. In the depicted embodiment, threaded adjust screws 27 are secured through the lower frame members 23 such that they press against the bearings 28. As the screws 27 are tightened, they force the bearings 28 to press against the clutches 20 which in turn press against the brake pads 29 and compress the springs 30 thereby increasing the intensity of the one-way friction.

Returning to FIG. 1, vertical frame member 7 and upper frame member 3 are preferably provided, extending upward and angularly outward with respect to the lower frame member 23. These frame members 7, 3 position upper arm exercise pulley 2*a*, 2*b* at a desired height such that the hand grips 1*a*, 1*b* can be grasped by a user for resisted pulling (as described below) to define a line of resistance (from the pulleys 2*a*, 2*b* to the user's hands) at a natural and comfortable height. The pulley 2*a* may be positioned, e.g., approximately at the shoulder height of the user. In one embodiment, the height of the pulley 2*a* may be adjusted, e.g., by pivoting 144 the upper arm 3. In the depicted embodiment, the hand grip 1*a*, 1*b* are coupled to arm exercise lines 4*a*, 4*b* running over the upper arm exercise pulleys 2*a*, 2*b*, a second arm exercise pulley 5, a third arm exercise pulley 11, such that the opposite ends of the lines engage arm exercise one-way clutch drums 15*a*, 15*b*. As shown in FIG. 2, preferably each line 4*a*, 4*b* is wound, e.g., in helical fashion around the corresponding drum 15*a*, 15*b*. Preferably each drum 15*a*, 15*b* is provided with a recoil spring 15*c*, 15*d* such that when a user releases or relaxes the grip or tension on a line 4*a*, 4*b*, the drum 15*a*, 15*b* will rotate in a retract direction 212 to return the lines 4*a*, 4*b* to its coiled configuration: Each drum 15*a*, 15*b* is coupled to a second shaft 35 via a one-way clutch 214*a*, 214*b*. Preferably, the arm exercise one-way clutches 214*a*, 214*b* are substantially identical to the leg exercise one-way clutches 20*a*, 20*b*. The one-way clutch is configured so that when a line 4*a* is pulled by a user in a first direction 216, the one-way clutch 214*a* engages with the second shaft to drive the second shaft 35 in first rotational direction 222. When the line 4*a* moves in a second, retract direction 212 (under urging of return spring 15*c*), the one-way clutch 214*a* disengages from the shaft 35 and overruns the shaft. Thus, in the depicted embodiment, the lines 4*a*, 4*b* are coupled to the same resistance mechanism, namely the flywheel 17, as are the skis. The action of the arms and legs independently contribute to the momentum of the flywheel.

Returning to FIG. 1, a friction belt 14 is provided engaging at least a portion (such as about 75%) of the circumference of the flywheel 17. Preferably one end of the friction belt 14 is coupled to a spring 13 while the other end is coupled, via line 134, ranging over friction band pulley 10 and second friction band pulley 6, to a speed controller clothing clip 8. In one embodiment, an elastic line member such as an elastic "bungee" cord 26 couples the line 134 to the clip 8.

When the clip 8 is coupled to the user, such as by clipping to the user's belt or other clothing, net movement of the user backward 114 on the exercise machine relative to the frame 23 will result in tightening the friction band 14 on the flywheel 17 (in an amount dependent, at least partly, on the spring constant of the spring 13 and/or the effective spring constant of the elastic cord 26), thus slowing the rotation of the flywheel 17. As described above, the flywheel 17 is driven by the movement of the skis 22 and/or hand grips 1*a*, 1*b* in a one-way fashion, i.e., such that, in the absence of braking, moving the skis and hand grips faster tends to rotate the flywheel faster.

When the user is in the rearmost position of the machine 136, the friction band is at its tightest around the flywheel, preventing it entirely from spinning. As the user begins exercising and moves forward 112, pressure is released from the friction band and the flywheel begins spinning. Once the user has reached the speed desired by the user (i.e., the level of effort desired by the user), the user continues to exercise at this level and the system will automatically substantially maintain the corresponding speed of the flywheel. If the user slows his or her pace, the user will begin to drift back on the machine 114, under gravity power because of the machine incline 142, resulting in the tightening of the friction band 14 and the slowing of the flywheel speed. As the user speeds up his or her pace, he or she will move forward on the machine 112, decreasing the pressure on the fiction band and thereby increasing the flywheel speed. Thus the system provides a method for speed control operated simply by the exerciser increasing or decreasing his or her level of effort. Thus there is no requirement for manual adjustments in order to change the intensity of the workout.

In practice, the user will mount the device, insert his or her feet into the foot support 21 of the skis 22 and grasp the hand grips 1. The user will attach the clothing clip 8 to his or her clothing. Initially the user will be near the rear-most position 136 and the friction band 14 will be at its tightest. The user will move the skis in reciprocating fashion with a normal skiing motion and, because of the resistance mechanisms described above, the user will begin to move up 112 the incline 142 toward the front of the machine 138 and will cause the flywheel to begin rotating. Once the flywheel begins to spin, as the user's position fore and aft on the machine changes, there will be resultant constant variations in the machine friction band tension on the flywheel. As the user slows, the momentum of the flywheel will tend to propel him or her backward. However, as the user moves back, the friction band is tightened, as described above, and thus the flywheel begins to slow down until a balance is attained. As the user speeds up, the friction band is eased, and the flywheel is allowed to accelerate. This system will thus automatically vary the machine speed based on the user's position without the need to make manual adjustments or input. The user can, however, adjust the machine in a number of ways to affect the intensity of the exercise, if desired. The user may turn the adjusting knobs 27 to increase or decrease the forward resistance (e.g., to simulate varying friction conditions of snow). The user may change the incline of the machine 142 to increase or decrease the intensity of the exercise. If desired, the user will also pull on the ropes or hand grips 1*a*, 1*b* in the desired fashion for upper body resistance exercise. The user may pull on the ropes in an alternating fashion, parallel fashion, using either arm alone or the user may refrain from pulling on the ropes at all. As the user expends a greater level of effort (the sum of leg backward effort and any rope-pulling), the machine will automatically adjust the amount of friction on the flywheel 17 owing to the user's movement up or down the incline of the machine, depending on the user's level of effort.

Figure 3:
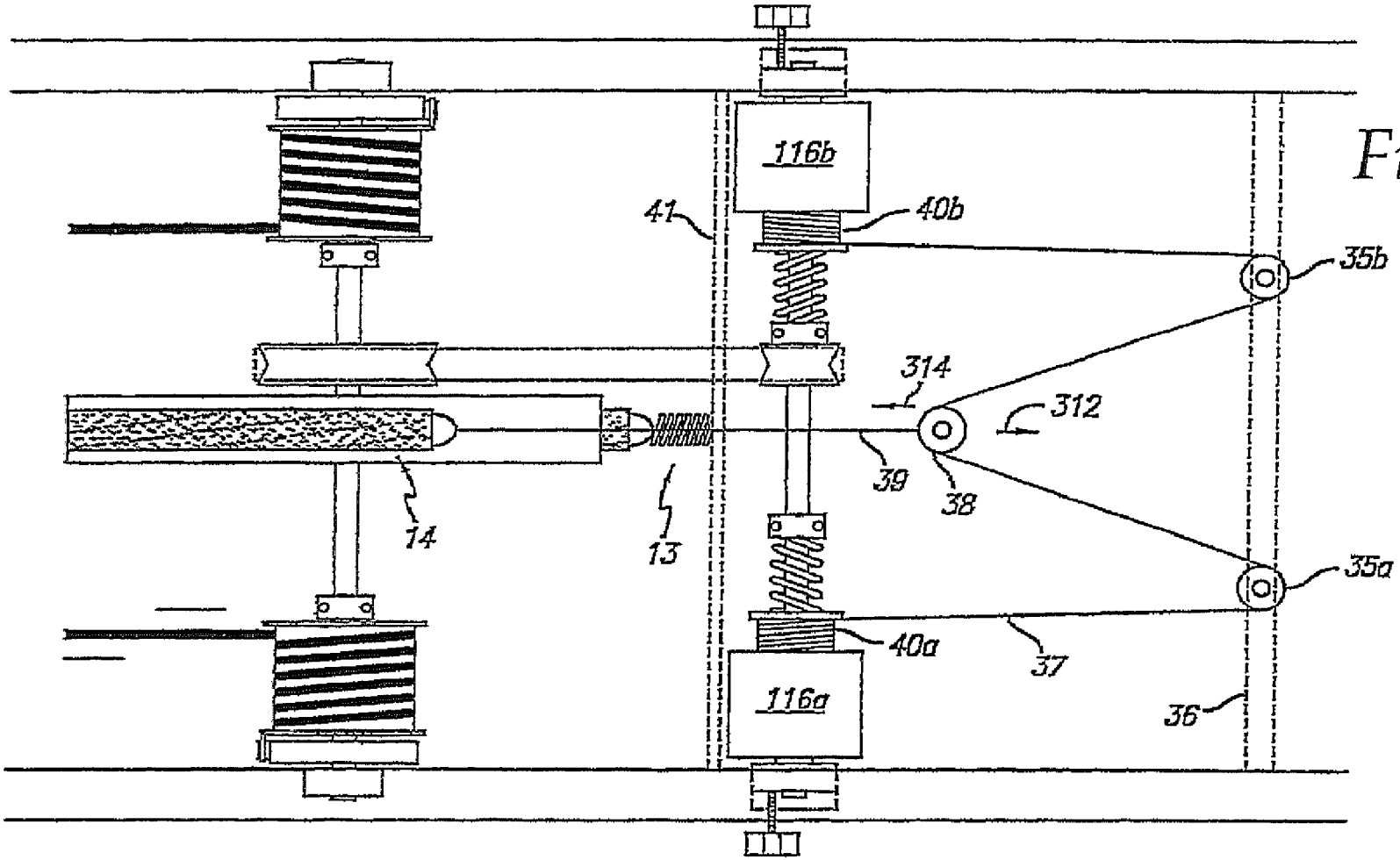
FIG. 3 is a top plan view similar to the view of FIG. 2 but showing a first alternate speed control mechanism.

A somewhat different speed control configuration is depicted in FIG. 3. In the embodiment of FIG. 3, there is no need for the friction strap 14 to be coupled via a line to the user's clothing. Instead, the depicted friction control is based on the fact that if a user moves upward (i.e., up the incline 142) toward the front of the machine 138, the machine, although each driven roller 116*a*, 116*b* will be alternatively driven in forward 118 and reverse 122 directions, there will be greater amount of forward rotation 118 than rearward rotation 122 as the user moves up the incline.

In the embodiment of FIG. 3, a line 37 is coupled between left and right rope spools 40*a*, 40*b* which rotate with the driven rollers 116*a*, 116*b*. Line 37 runs, in order, around a left fixed pulley 35*a*, a movable speed control pulley 38, and a right fixed pulley 35*b*. The amount of line 37 which, at any one time, is not wound on the spools 40*a*, 40*b* (i.e. the amount between the spools 49*a*, 40*b* and running around pulleys 35*a*, 38, 35*b*) will be referred to as the free line. If a user is maintaining his or her level of effort and thus staying at an average fixed location on the incline, as the user reciprocates the skis left and right, the rope 37 will move from one spool to the other, with no net movement of the movable pulley 38. Furthermore, as the user moves the left ski 22*a* backward and the right ski 22*b* forward an equal amount, the line 37 will unspool from the left spool 40*a*, and spool a substantially equal amount onto the right spool 40*b*. When the user in the reciprocating motion moves the right ski 22*b* backward, the same amount of line 37 will spool off the right spool 40*b* and onto the left spool 40*a*. However, as the user expends a greater amount of energy, the user will move up the incline and thus on average, the forward strokes of the skis will be longer than the rearward strokes. This will result in the same amount of line 37 being unspoiled from the spools 40*a*, 40*b*, causing the effective free line length from the left spool 40*a* to right spool 40*b* (not considering the amount of line on the spools) to lengthen. As the effective length of the line lengthens, the movable pulley 38 is pulled forward 314, under urging of spring 13 which relaxes somewhat causing the line 39 to pull less tightly on the friction band 14, decreasing friction on the flywheel 17. As a result, as the user moves upward up the incline, the friction band 14 will loosen. As the user moves down the incline toward the rearmost position 136, the amount of free line will shorten, moving free pulley 38 rearwardly 312 and causing the friction band 14 to tighten.

Figure 4:
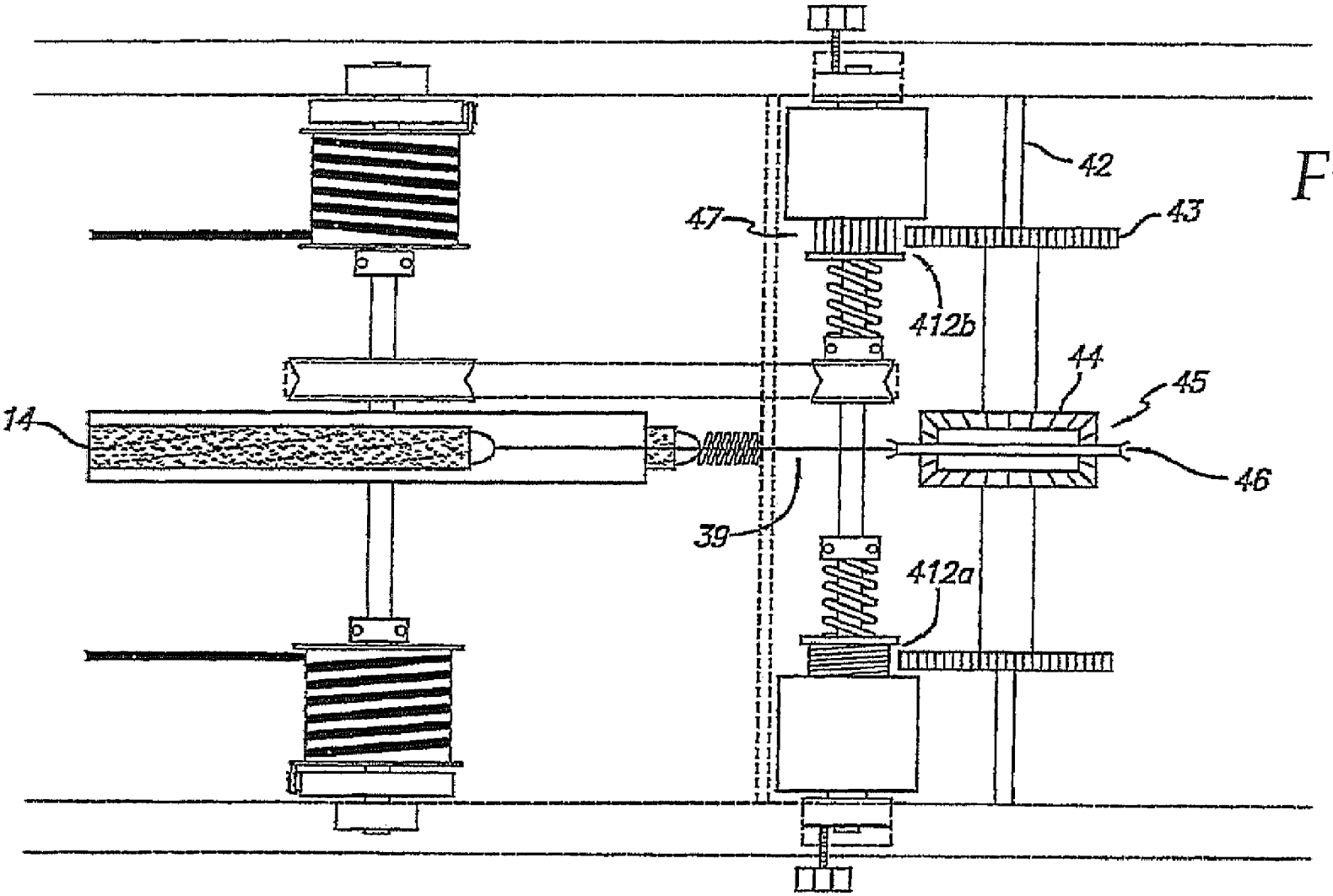
FIG. 4 is a top plan view similar to the view of FIG. 2 but showing a second alternate speed control mechanism.

FIG. 4 depicts another embodiment which uses a series of miter gears 44, 45 formed in a fashion similar to an automobile differential gear. With the differential gears of an automobile, (including those found in some toy automobiles) considering a car with wheels off the ground, spinning a wheel in one direction with the driveshaft locked results in other wheel spinning in the opposite direction. Unlocking the driveshaft, as long as one wheel spins an amount equal and opposite to the other, the driveshaft remains unchanged. If both wheels spin a net amount in the same direction, the driveshaft will rotate.

In FIG. 4, a first set of drive gears 47 are attached to the rollers 116*a*, 116*b*. These engage a second set of drive gears 43 which are connected to a set of first miter gears 44 and encircled by a friction band cord spool 46. A friction band cord 39 wraps around the spool 46 and attaches to the friction band 14. When one ski goes forward and the other goes back an equal amount, the opposite spinning first miter gears 44 counter each other in an equal and opposite manner. Since skiing is an alternating activity, the gearshaft 42 driven via gear trains 412*a*, 412*b* will remain relatively still while a user is skiing in one position on the machine, i.e. moving the skis substantially the same amount forward as backward. As a result the friction band cord spool 46 remains unchanged. If the user's average position moves fore or aft on the machine, the gearshaft 42 will turn in one direction or the other. Thus, as the user moves forward or backward on the machine, the gear shaft 42 will rotate forward or backward, via the differential or miter gears 44, 45, to rotate the friction band cord spool 46, causing line 39 to loosen or tighten so as to loosen or tighten the friction band 14. As will be clear to those of skill in the art, a number of differential gear devices can be used for this purpose.

Figure 5:
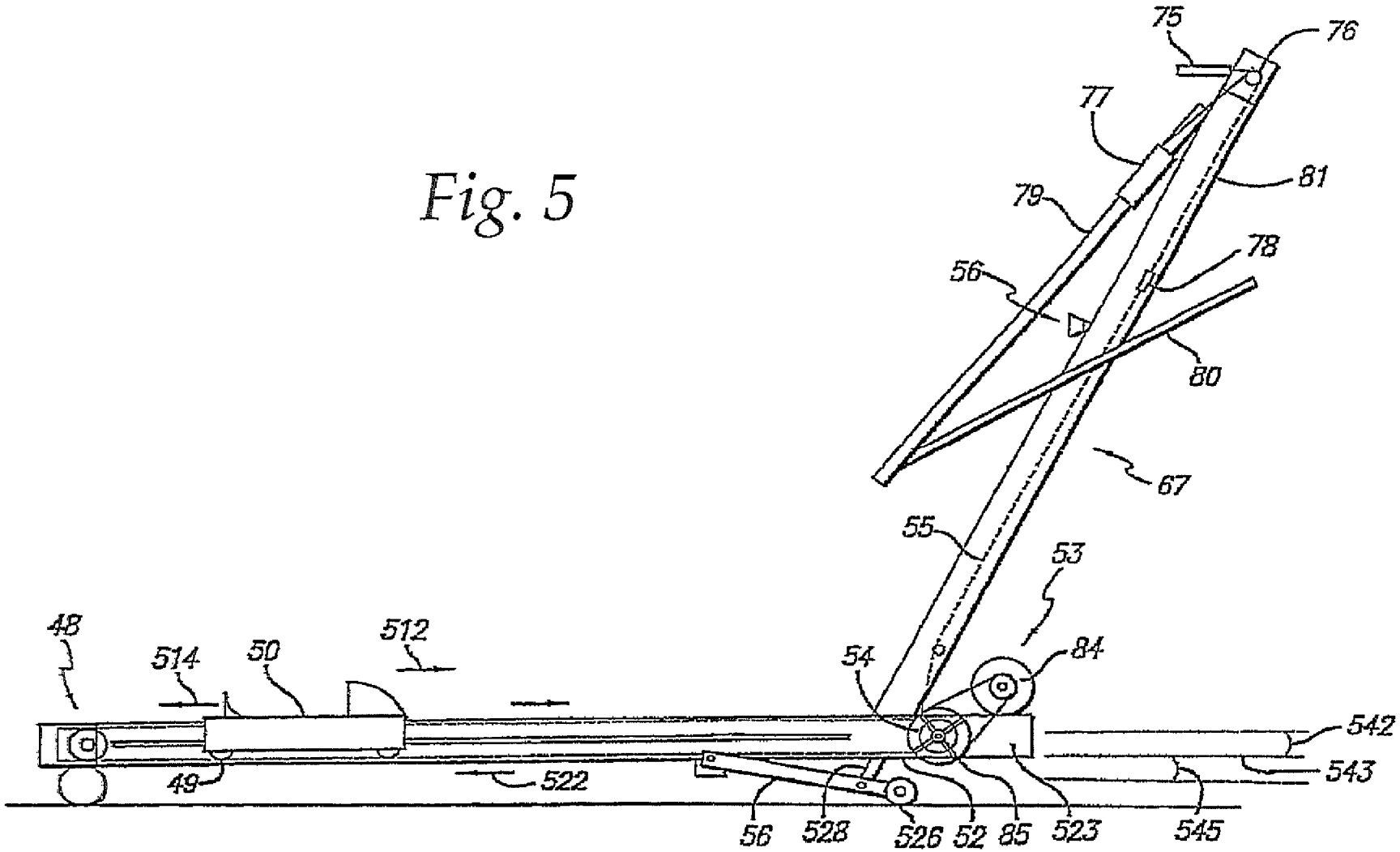
FIG. 5 is a side elevational view of an exercise apparatus according to an embodiment of the present invention.

FIG. 5 depicts an embodiment showing a number of alternative configurations. In the embodiment of FIG. 5, the user's feet, rather than being used to drive a simulated ski, instead drive a footcar 50 forward and back. The footcar 50 has wheels 49 with one-way clutches such that the footcar 50 is free to move in the forward direction (i.e., the wheel clutches are disengaged). When a footcar 50 is moved in the rearward direction, the wheels frictionally engage the inside of the surface of the conveyer belt 52 (i.e., the wheels are locked as footcar 50 is moved in the rearward direction).

FIG. 5 also depicts another method for controlling speed by driving a flywheel shaft with a motor. Using this method negates the need to incline the machine, as the motor overcomes any internal friction. The speed of the motor can be set manually such as on a treadmill or the speed potentiometer can be tied to one of the speed controllers described above such that the machine speed is dependent on the user's position on the machine.

In the embodiment of FIG. 5, during backward motion 514 of the footcar 50, while the footcar wheels 49 are locked, the amount of resistance to the backward motion of a given footcar perceived by the user will depend principally on the amount of forward friction on the opposing footcar and the inclination 542 of the exerciser with respect to the horizontal 543.

Without wishing to be bound by any theory, it is believed that when an exerciser is exercising on a device according to the present invention, and if there is no net or average fore-aft movement (i.e., the exerciser is substantially maintaining his or her fore-aft position) the amount of resistance to a backward leg thrust is equal to the amount of resistance to forward movement of the opposite leg. It is believed that when the device is inclined, the resistance to forward movement has a contribution both from the one-way friction brake described above and resistance to movement up the incline, against gravity. During use of the device, the speed of rearward leg movement (ignoring arm exercise, for the moment) will be regulated by the speed of rotation of the flywheel which will be moving at a substantially constant speed if the user is maintaining his or her fore-aft position on the machine. It is believed that the friction band, when it is applied as described to selectively slow the flywheel, is operating so as to balance the effect of gravity when the machine is inclined, in the sense that, if there were no friction band or other selective flywheel speed control, the user would tend to slide backward toward the rear most position on the machine when the machine is inclined. It is believed that, in situations where a user moves forward or aft on the machine, there is a temporary small difference between the forward resistance and the rearward resistance.

As noted above, during bilateral motion using the exercise device of FIG. 5, the user will tend to oscillate somewhat forward and backward (even if the user is maintaining a constant average fore-aft position with respect to the exercise machine), as the user pushes back on each leg alternately. If the machine is inclined such that the track along which the footcars move is tilted upwards 542, with each forward oscillation, the user is also lifting his or her center of gravity a certain amount. The amount that the user lifts his or her center of gravity on each stride will depend not only on the length of the stride but also on the amount of inclination 542. According to one embodiment, the exercise machine can be adjusted to affect the perceived difficulty or level of activity by increasing or decreasing the inclination.

Figure 5A:
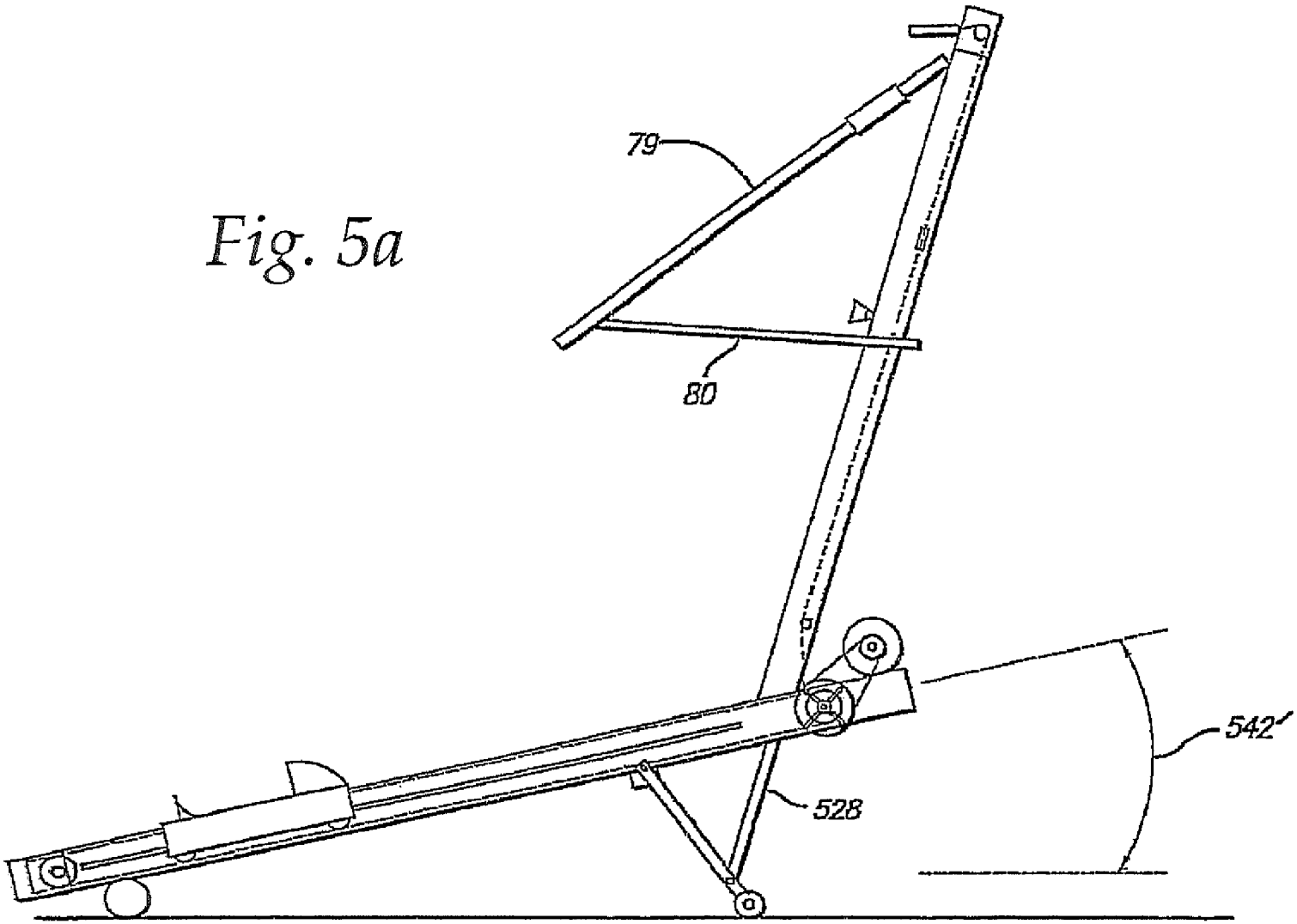
FIG. 5A is a side elevational view of the device of FIG. 5, but showing the device configured for increased inclination and with the arm rails extended.

In the depicted embodiment, the forward feet 526 are coupled to the lower frame 523 by pivot arm 66. The pivot arm 66 can be held in any of the variety of pivot locations by adjusting the extension of link arm 528. Thus, if the user wishes to increase the inclination 542 to an inclination greater than that depicted in FIG. 5, the user may disengage the far end (not shown) of link arm 528, which may be engaged by a plurality of mechanisms including bar and hook, pin and hole, rack and pinion, latching, ratcheting or other holding mechanisms, and extend the link arm 528, e.g., to the position depicted in FIG. 5A to increase the inclination of the machine to a higher value 542', and resecure the far end of link arm 528 as depicted in FIG. 5A. If desired, the apparatus at FIG. 5 can be adjusted so that the footcars 50 move along a track which is angled downward toward the front of the machine (to simulate declined skiing situations).

When the device of FIG. 5 is set at an inclination 542 up to about 10 degrees, it is anticipated that users will typically employ the arm ropes 75. At inclinations greater than about 10 degrees, it is anticipated that users may prefer to use the rail system 77, 79. The rail system is believed to offer an upper body exercise similar to using a pair of banisters when climbing stairs.

As discussed above in connection with FIGS. 1 through 4, a variety of mechanisms can be used to sense the position and/or movement of the user along the fore-aft axis of the machine and to control speed, in response. In the embodiment of FIG. 5, similar devices can be used for sensing fore-aft position of the exerciser. In the embodiment of FIG. 5, it is preferred to use the position of the user to control the speed with which the belt 52 moves, e.g., by controlling the speed of motor 53. For example, the speed of the motor 53 may be controlled by a motor speed potentiometer whose setting is determined by an arm coupled to a line or cable. Thus, whereas in the embodiments of FIGS. 1 through 4, pulling on a line 34, 39 resulted in tightening a friction band 14, in the embodiment of FIG. 5, pulling on a similar line in response to the fore-aft position of the exerciser moves a potentiometer arm so as to change the motor speed 53. Thus, as the user moves forward on the machine of FIG. 5, the potentiometer is preferably moved so as to increase the speed of motor 53, and when the user moves backward, towards the rear of the machine, the potentiometer is moved to a position so as to decrease the speed of the belt 52. In the embodiment depicted in FIG. 5, rather than sensing the position of the user via a clothing clip or differential motion sensor, a sonar transducer is mounted to the upright frame 67 preferably at a height approximately near the user's abdomen to measure his or her distance from the front of the machine. In one embodiment, a microcontroller is used to operate the motor speed based on inputs from the transducer, e.g., according to the scheme depicted in FIG. 10, discussed more thoroughly below. A number of sonic transducers can be used for this purpose, including model part #617810 available from Polaroid.

Figure 6:
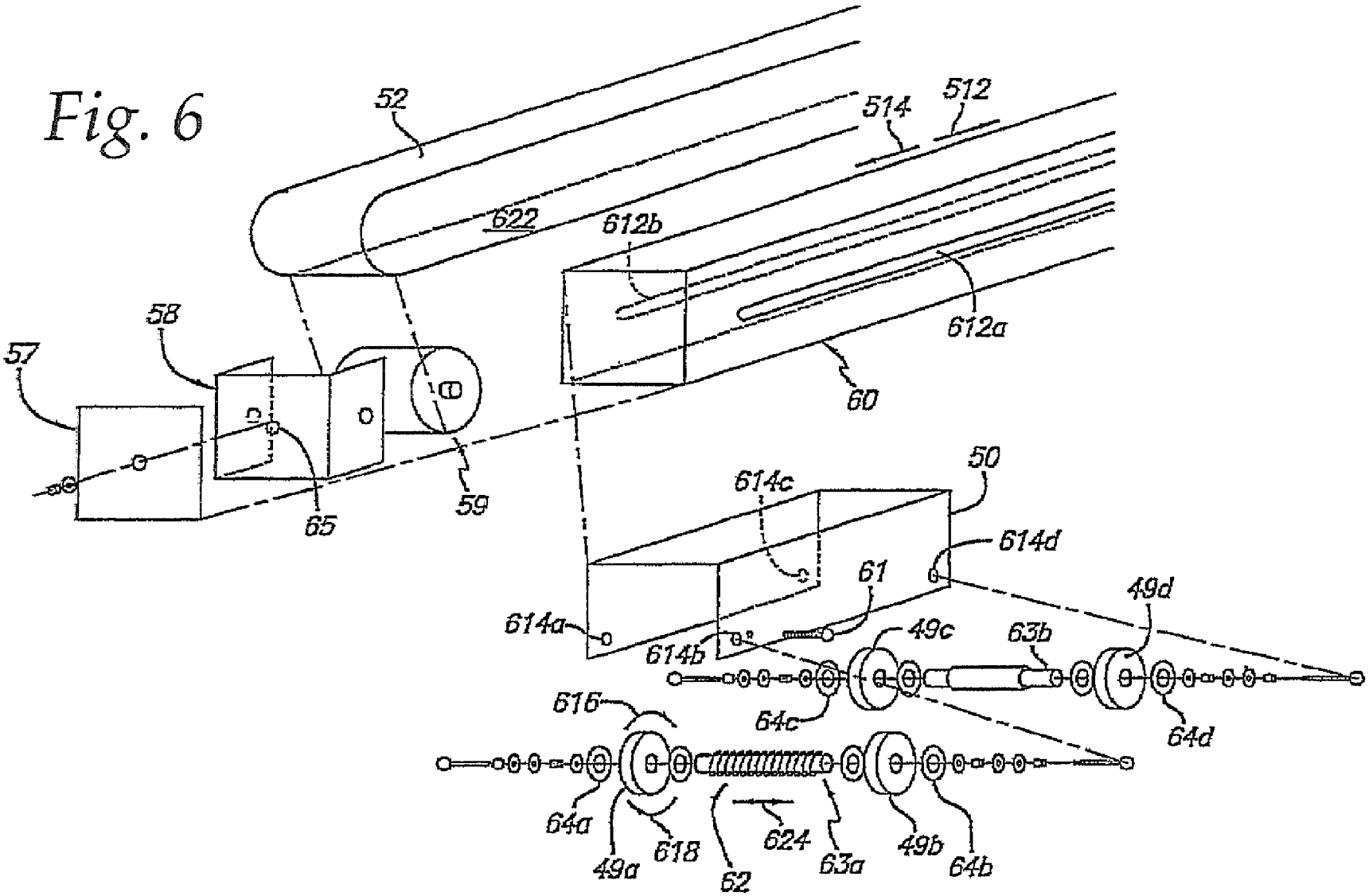
FIG. 6 is a partial exploded perspective view of a footcar and conveyor belt according to an embodiment of the present invention.

As depicted in FIG. 6, the footcar 50 has a generally inverted U-shape configured to fit over the top of a rectangular tube section 60. The rectangular tube section 60 includes longitudinal slots 612*a*, 612*b* which accommodate the axles 63*a*, 63*b* of the footcar. The axles 63*a*, 63*b* extend through the footcar axle bearings 614*a*, 614*b*, 614*c*, 614*d* and through the slots 612*a*, 612*b* as the footcar 50 and the square tube 1470, the axles 63*a*, 63*b* bear footcar wheels 49*a*, 49*b*, 49*c*, 49*d*. Each of the wheels 49*a*, 49*b*, 49*c*, 49*d* are configured with a one-way clutch, as described above, such that the wheels 49*a*, 49*b*, 49*c*, 49*d* roll freely in a first direction 616 but are locked against rotation in the opposite direction 618, when footcar 50 is moving aft 514. A conveyor belt 52 is positioned in the interior of the square tube 60 with the bottom surfaces of the footcar wheels 49*a*, 49*b*, 49*c*, 49*d* contacting the inner surface 14802 of the lower limb of the conveyor belt 52. The rear end of the conveyor belt 52 is retained by conveyor belt idler 59 held by an idler retainer 58 and backer plate 57. An adjustable screw 65 can adjust the fore-aft position of the idler retainer 58 to adjust the tension on the belt 52. The fore end of the belt 52 passes around the conveyor belt drive roller 70 (FIG. 7) which is mounted on a drive shaft 83. Preferably the footcars 50 are configured to provide adjustable resistance when moving in the forward 512 direction (independently of the amount of perceived resistance in the reverse direction).

In the embodiment described above in connection with FIGS. 1 through 4, it was described how it was possible to construct one-way forward leg resistance in connection with the one-way clutches 20*a*, 20*b*. In the embodiment of FIGS. 5 and 6, it is also preferable to provide an amount of forward leg resistance and, if desired, a mechanism similar to that discussed above in connection with FIGS. 1 through 4 can be used. In the embodiment of FIG. 6, friction pads 64*a*, 64*b*, 64*c*, 64*d* can be made to bear against the outside surfaces of the wheels 49*a*, 49*b*, 49*c*, 49*d*. In the depicted embodiment, the wheels 49*a*, 49*b*, 49*c*, 49*d* are free to move laterally 624 a certain amount. Thus, in one embodiment, when adjusting screw 61 is tightened this screw presses against the outside of the friction pad 64*b* which in turn presses against the outside surface of the wheel 49*b*. A brake spring 62 pressing against the opposite side of the clutch 49 is provided to give increasing pressure against the tightening of the adjust screw 61, resulting in greater friction to the clutch in the free wheel direction 616.

Figure 12:
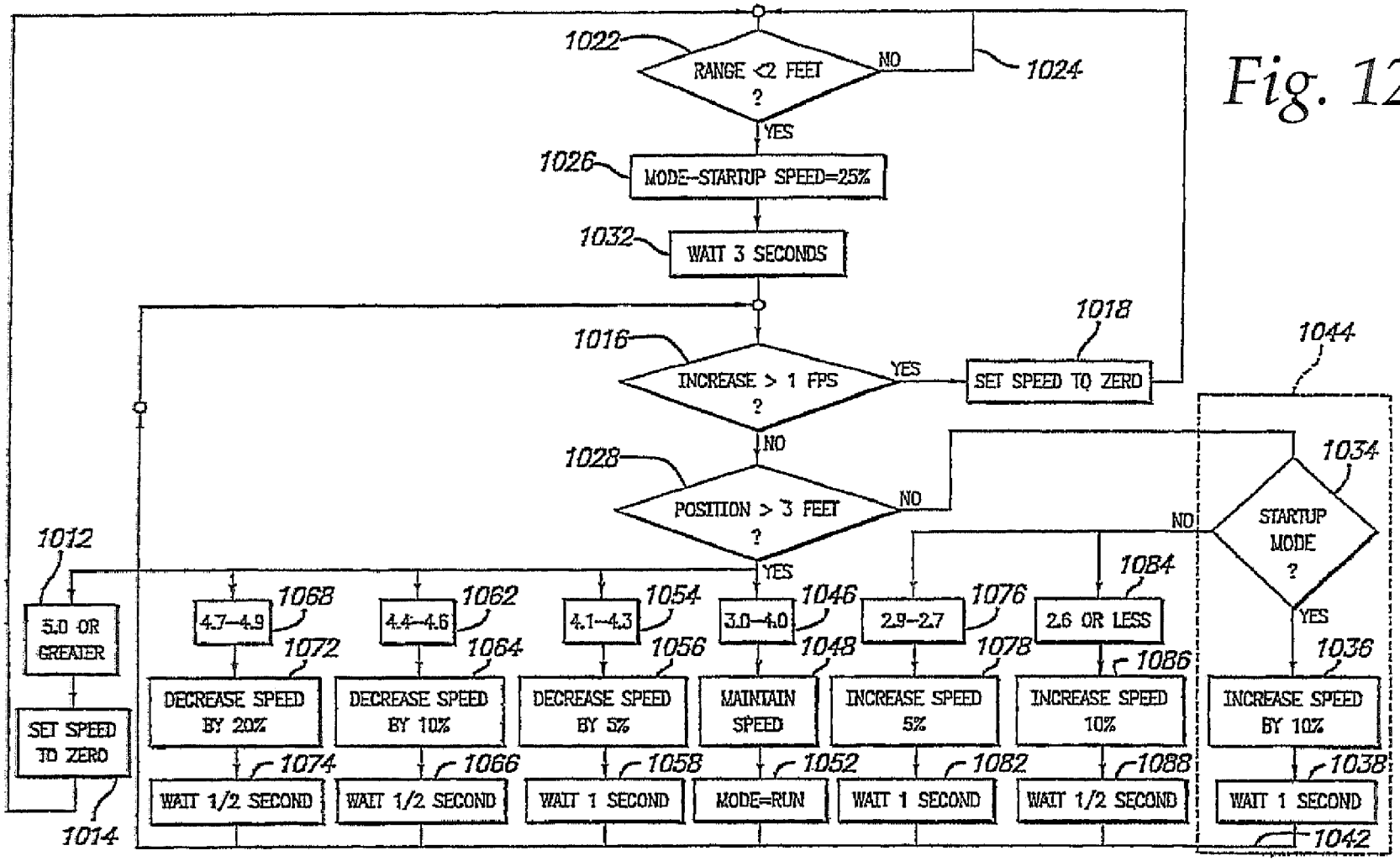

Another embodiment is depicted in FIGS. 11 and 12. a pair of slidable footcars (of which only the left footcar 1102 is seen in the view of FIG. 11) is mounted on parallel tracks (of which only the upper surface of the left track 1104 is seen in the view of FIG. 11). Although the tracks can be configured to provide a constant separation, such as a separation of about 12 inches (about 30 cm), the apparatus can also be configured to provide adjustable separation, e.g. via a rack and pinion mounting (not shown). The tracks are long enough to accommodate the full stride of the user, normally about 30 inches to 50 inches (about 75 cm to 125 cm).

The cars 1102 are designed to slide or travel linearly up and down 1106 the tracks. In the depicted embodiment, the cars travel on the tracks 1104 supported by wheels 1108*a, b* which are configured to maintain low rolling resistance to the tracks while carrying the full weight of the user.

A cable or belt 1110 attaches to the back of each car 1102 and extends in a loop over rear pulley 1112 and front pulley with integral one-way locking mechanism 1114, to attach to the front of the car 1102. The integral one-way locking mechanism of the front pulley can be, for example, similar to that used for the one-way clutches 20 *a, b* of the embodiment of FIG. 1. In the depicted embodiment, the front pulley 114 and a speed controlled flywheel 1116 or motor (not shown) are mounted on (or coupled to) a common drive axle 1118. The flywheel may be mounted on the drive axle in a fashion similar to that described for mounting a flywheel on shaft 35 in the embodiment of FIG. 2. Preferably, the cable or belt is designed to grip the front pulley 1114 such that there is little or no slippage between the cable 110 and the pulley 1114, even under load. In one configuration, the belt 1110 is a geared belt of the type used for a timing belt (e.g. a nylon belt) with mating cogs being provided on the forward pulley 1114.

As depicted in FIG. 12, each forward pulley 1114 *a, b* is configured with a one-way friction mechanism 1124*a, b*. The one-way locking mechanism and one-way friction mechanism are configured such that when a car 1102 is moved in rearward direction, the locking mechanism 1124 engages and spins the drive axle 1118, driving the flywheel 1116. When a car 1102 is moved in the forward direction, the one-way locking mechanism 1124 releases and the one-way friction mechanism 1122 causes a rearward force on the car 1102 transferred from the momentum of the moving flywheel 1116 or motor force. The intensity of the one-way friction mechanism 1122 can be made adjustable (such as by adjusting the force of springs 1121 *a, b* and, thus, washers 1122 *a, b* on the friction pads 1124 *a, b*) or kept at a fixed level. The inclination of the tracks can be varied, as described for other embodiments herein. Arm exercise mechanisms can be coupled to the drive shaft as described for other embodiments herein.

Figure 7:
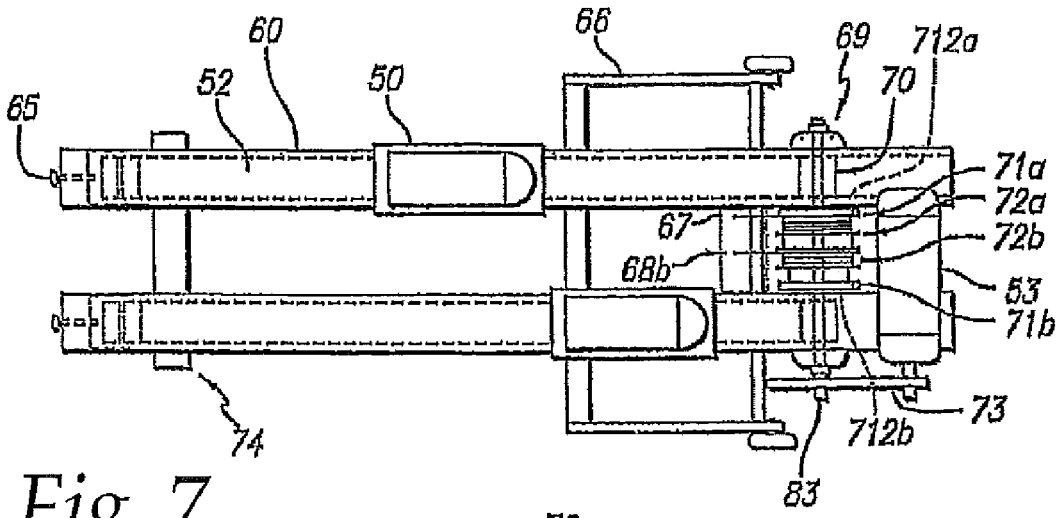
FIG. 7 is a top plan view, with upright frame elements removed, of an exercise device according to an embodiment of the present invention.
Figure 8:
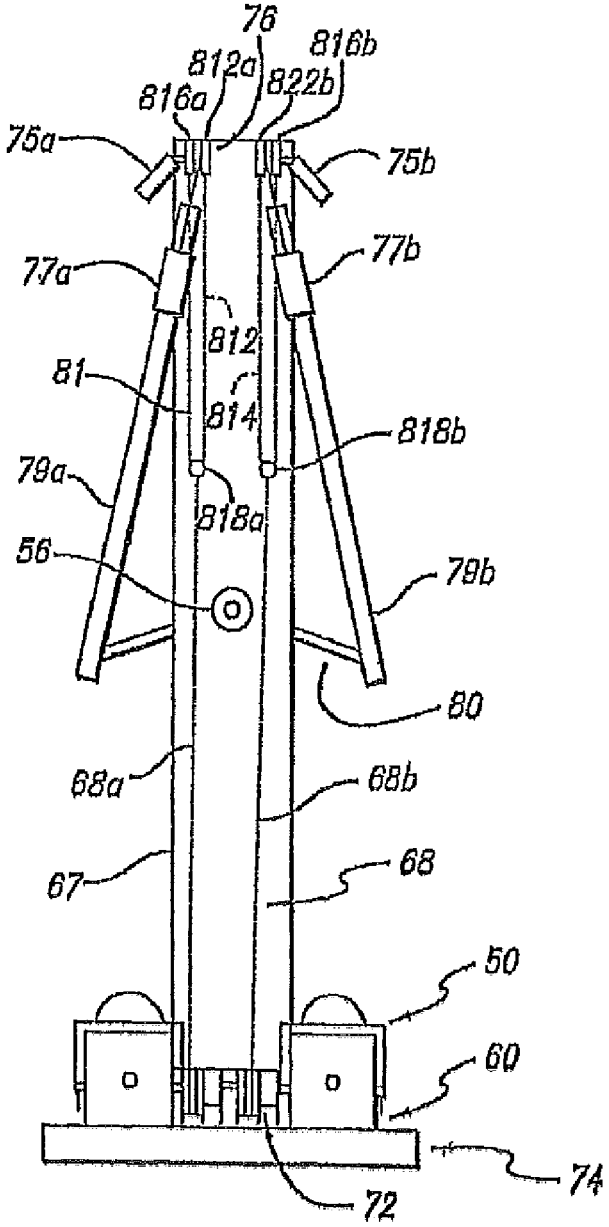
FIG. 8 is a rear elevational view of an exercise device according to an embodiment of the present invention.

FIGS. 7 through 9 also depict an arm exercise mechanism. In the depicted embodiment, an upright frame element 67 accommodates left and right ropes 812, 814. At first end of rope 812 is coupled to a left hand grip 75*a*. The rope 812 then is positioned over a first fixed pulley 816*a*, over a second movable pulley 818*a*, (coupled to arm line 68*a*) to a second fixed pulley 822*a* and thence coupled to a rail hand grip 77*a* configured to slide along rail 79*a*. As can be seen in FIG. 8, a similar arrangement is provided for the right rope 814. If the machine is declined 545, it is anticipated that the user will typically use the hand grips 75*a*, 75*b* rather than the rail grips 77*a*, 77*b*.

The arm exercise lines 68*a*, 68*b* are wrapped around spools 72*a*, 72*b* coupled by one-way clutches 712*a*, 712*b* to the driveshaft 83. A number of one-way clutches can be used for this purpose, including clutches similar to those 20*a*, 20*b* used in connection with the driven rollers 116*a*, 116*b*. The spools 72*a*, 72*b* are coupled by the clutches 712*a*, 712*b* to the driveshaft 83 in such a manner that unwinding either of the ropes 68*a*, 68*b* by pulling on the hand grips 75*a*, 75*b*, 77*a*, will cause the clutch to engage and lock against the shaft 83 in the same direction that the shaft is spinning the belt drive rollers 70. A pair of recoil springs 71*a*, 71*b* retract the ropes 68*a*, 68*b* onto the spools 71*a*, 71*b* when the user relaxes tension on the ropes 68*a*, 68*b*.

By pulling on either end of the ropes 812, 814, i.e., by pulling on hand grips 75*a*, 75*b* or rail grips 77*a*, 77*b*, the movable pulleys 818*a*, 818*b* are, respectively, pulled upward, unspooling lines 68*a*, 68*b* from the spool 72*a*, 72*b* such that the user perceives the resistance to be pulling on the handle 75, 77 (greater than internal or friction resistance) if the speed of pulling is such that the spools 72*a*, 72*b* are rotating at a rotational rate faster than that of the current rotational rate of the shaft 83. The linear speed of the rope ends 75*a*, 75*b*, 77*a*, 77*b* is related to rotational rate of the spools 72*a*, 72*b*. In one embodiment, this can be done by pulling each rope 68*a*, 68*b* until it is completely unwound from the spools 72*a*, 72*b* and rewrapping it under manual guidance, on a different portion of the spools with a different diameter. The same effect could be achieved using a bicycle-type derailleur to automatically shift the ropes from one diameter section to another. Although in the depicted embodiment only two diameters of spool are shown, three or more could be provided if desired, or a single diameter could be provided. It is also possible to couple the spools 72*a*, 72*b* to the driveshaft 83 via a linkage such as a chain drive, belt drive, gear train or the like, which could be provided with changeable transmissions for changing the effective ratio and thus the relative resistance to arm exercise.

In use, the exerciser can choose to manually control the motor speed, e.g., via a manual potentiometer knob or other adjustment, or can rely on the speed controller described above for automatic adjustment. The user steps onto the foot-cars 50 and, beginning at the rearmost position, typically, starts an alternating "walking" type motion. Initially, the conveyor belts are stopped and thus the wheels with the one way clutches on the foot cars allow the cars to slide forward but not backward. As a result, the user moves towards the front of the machine. As the user moves forward, the speed control circuit, as described above, causes the motor 53 to begin driving the belts. As the user approaches the front of the machine, the user may, if desired, grasp the hand grips 75*a*, 75*b* or 77*a*, 77*b*, preferably continuing the walking motion. As the motor begins to move the conveyor belts, the user's position is changed relative to the frame of the exerciser and the speed control circuit, described above, continually adjusts the speed of the conveyor belts to the user's stride.

Preferably the rails 79 can be pivoted so that they can be folded out of the way as depicted in FIG. 5 or extended as in depicted in FIG. 5A for use. To adjust the position of the rails 79 adjust knobs 82 (FIG. 9) are loosened to allow rail support 80 to slide freely. When the rails 79 are positioned in the desired location, the knobs 82 are tightened to hold the rails in the desired position.

FIG. 10 depicts a procedure that can be used for adjusting the speed of motor 53. In one embodiment the procedure depicted in FIG. 10 is implemented using a microcontroller for controlling the motor. In the embodiment of FIG. 10, it is preferred that if the user is more than a predetermined distance aft (such as five feet or greater from the front of the machine) 1012, the belts 522 will be immobile, i.e., the motor speed will be set to zero 1014. Similarly, if at any time the distance of the user from the front of the machine changes at a rate of greater than one foot per second for greater than 1.5 feet 1016, the belts are similarly stopped by setting the motor speed to zero 1018. The procedure preferably differs somewhat depending on whether the machine is in start-up mode (e.g., after the user initially mounts the machine) or is in normal or run mode.

Preferably, the unit will not start unless the range (i.e., the distance of the user from the front of the machine) is less than a predetermined amount such as two feet 1022. If the user is not in this range, the procedure loops 1024 until the user moves within range. Once the user has moved within range, the machine is initially in start-up mode and the speed is set to a predetermined initial speed such as 25% of maximum speed 1026. In one embodiment, the controller will ramp up a speed gradually so that the output from the microcontroller board can go immediately to 25% upon start-up. Assuming the maximum velocity condition has not been exceeded 1016, if the range stays below three feet 1028 within three seconds 1032 while the device is in start-up mode 1034 the speed will increase by 10% 1036 each second 1038, looping 1042 through this start-up procedure 1044 until the user exceeds a range of three feet 1028. Once the user exceeds a range of three feet from the front of the machine 1028, i.e., is within the range of three feet to four feet 1046, the motor speed 53 will be maintained 1048 and the machine will thereafter be considered to be in run mode 1052.

In general, the speed of the machine will be maintained constant whenever the user is in a predetermined range such as three to four feet 1046. Once the device is out of start-up mode, in general, the procedure will decrease motor speed if the position exceeds four feet or increase motor speed if the range falls below three feet, (until such time as the user exceeds a predetermined maximum range 1012 or a predetermined speed 1016). In the depicted embodiment, if the range goes to 4.1 to 4.3 feet 1054 the speed will be decreased by five percent 1056 every second 1058 until the range is back to three to four feet 1046 at which point the present speed will be maintained 1048. If the range goes to 4.4 to 4.6 feet 1062 the speed will be decreased by 10 percent 1064 every half second 1066 until the range is back to three to four feet 1046. If the range goes to 4.7 to 4.9 feet 1068 the speed will be decreased by 20 percent 1072 every half second 1074 until the range is back to three to four feet. If the range exceeds five feet 1012, the motor speed will be set to zero 1014 and the unit will not start again until the range is less than two feet 1022. If the range goes to 2.9 to 2.7 feet 1076 the speed will be increased by five percent 1078 every second 1082 until the range is back to three to four feet. If the range goes to 2.6 feet or less 1084 the speed will be increased by 10 percent 1086 every half second 1088 until the range is back to three to four feet or full speed is attained, at which point present speed will be maintained. As will be clear to those of skill in the art, the number of categories of speed, the amount of increase in speed and the rate at which speed increments are added can all be varied. Additionally, it is possible to define motor speed as a continuous function of position, rather than as a discrete (stepwise) function. Other types of control can be used such as controls which automatically vary the speed at predetermined times, or in predetermined circumstances, e.g., to simulate different snow or terrain conditions, controls which automatically raise or lower the elevation 528, 542 to simulate variations in terrain and the like.

In light of the above description a number of advantages of the present invention can be seen. The present invention more accurately simulates natural exercise than most previous devices. In one embodiment the device provides resistance to forward or upward leg movement rather than only rearward leg movement. Preferably forward leg movement resistance can be adjusted. Preferably the device controls the speed and/or resistance offered or perceived and, in one embodiment speed is controlled in response to the fore-aft location of the user on the machine. In one embodiment, the fore-aft location is detected automatically and may, in some embodiments, be detected without physically connecting the user to the machine, e.g., by a clothing clip or otherwise. The device is capable of providing upper body exercise, preferably such that, as a user maintains a given level of overall effort, expenditure of greater lower body efforts permits expenditure of less upper body effort and vice versa. Preferably the arm exercise is bilaterally independent such that user may exercise left and right arms alternately, in parallel, or may exercise only one or neither arm during leg exercise.

A number of variations and modifications of the present invention can be used. In general, the described method of speed control (preferably involving automatically adjusting speed or perceived resistance based on fore-aft position of the user, without the need for manual input or control) is applicable to exercise machines other than ski simulation machines, including treadmill or other running or walking machines, stair climbing simulators, bicycling simulators, rowing machines, climbing simulators, and the like.

Although FIG. 1 depicts a device inclined upward in the forward direction, it would be possible to provide a machine which could be inclined downward in the forward direction if desired, although this would remove the gravity-power aspect of the configuration.

Although embodiments are described in which speed control is provided by a braked flywheel, other speed control devices can also be used. The flywheel could be braked by a drum-type brake or a pressure plate- or pad-type brake in addition to the circumferential pressure belt brake. The drive roller 116 could be coupled to drive an electric generator for generating energy, e.g., to be dissipated with variable resistance. The flywheel 17 can be provided with fins, blades, or otherwise configured to be resisted by air resistance.

Although in FIG. 2, two shafts are depicted 31, 35, coupled by a belt 18, it would be possible to have the clutches 20*a*, 20*b* coupled directly to the flywheel shaft 31, or otherwise to provide only a single shaft. Although it is preferred to use the same resistance mechanism (e.g. flywheel 17) from arm and (backward) leg motion, it would be possible to provide separate resistance devices (such as two flywheels).

Although the embodiment of FIG. 5 depicts two separate treadmills, one for each footcar, it is possible to provide a configuration in which a single treadmill is provided extending across the width of the device. In situations where two treadmills are provided, it would be possible to configure the device such that the treadmills can move at different speeds (such as by driving each with a separate motor or providing reduction gearing for one or both treadmills), e.g., for rehabilitative exercise and the like.

In one embodiment, the inclination 542 can be changed automatically, e.g., by extending link arm 528 using a motor to drive a rack and pinion connection. Preferably, the motor is activated in response to manual user input or in response to a pre-programmed or pre-stored exercise routine such that the device can be elevated during exercise.

Although in the embodiment of FIG. 5 the speed of the belt movement was adjusted by adjusting the speed of the motor 53, it would also be possible to use a constant-speed motor 53 and employ, e.g., shiftable gears to change the belt speed. It is also possible to provide speed control which is configured to provide a constant speed rather than a variable or adjustable speed.

Although it is recognized that there may be some amount of resistance to forward (or upward) leg movement arising from internal machine resistance and/or overcoming the effects of gravity, preferably the exercise device of the present invention can provide forward or upward leg movement resistance which is greater than internal machine resistance and/or gravity resistance and preferably is adjustable (which internal machine resistance and gravity resistance typically are not).

Although it is anticipated that users will typically perform leg exercise in an alternating, reciprocal fashion, preferably the exercise device does not force the user into this type of exercise. In the depicted embodiments, there is nothing in the machine that would prevent a user from moving one leg more vigorously than the other (or even keeping one leg stationary) although it might be necessary to adjust speed control to accommodate this type of movement.

Perhaps the most important advantage of the present invention is its ability to replicate the forces found in nature. This advantage is illustrated in its simplest form by the graphical representation of FIG. 13. For most activities involving muscle exertion, a person increases the amount of force applied during the course of a movement. For example, when a person throws a ball, the force he exerts on the ball is greatest just before his release. The same is true for running, biking, rowing, etc.

Generally, the present invention consists of a user mountable carriage designed to slide in the fore and aft direction. The carriage contains a power transfer element, such as pedals, arm levers or the like, which convert the user's motions into a means for propelling the carriage relative to a dynamic element. A dynamic element generally consists of an endless belt or the like driven by a motor or by a slight incline to a base frame. Additionally, a rearward friction or force element causes a rearward force against the carriage preferably relative to the dynamic element. This rearward force to the carriage can simulate the drag and other resistance encountered in nature.

As a user operates the motion machine designed according to the principles of the present invention he generates a cyclic motion of the user carriage caused by the reciprocating action of his arms and/or legs. As a result, the carriage will be in a constant state of acceleration and deceleration within its framework. For discussion purposes, this cyclic motion includes and will be defined as the power stroke, (such as when a user begins pushing on a pedal) and a rest stroke (such as when a user reaches the bottom of his pedal stroke). During the power stroke the user sends power through the power transfer element on the carriage to the dynamic element. During the rest stroke, the carriage is pushed by the dynamic or other force element.

A speed controller, such as a potentiometer on the motorized version of this embodiment, controls the speed of the machine. Alternatively, an automatic speed control can be used which ascertains the fore/aft position of the carriage within the support frame and sets the motor speed accordingly. More specifically, when the carriage is positioned on the middle of the frame, the speed controller maintains the current motor speed. If the carriage begins to move rearward due to the user slowing down, the speed controller slows the motor speed to encourage the carriage to become centered again. Similarly, if the carriage begins to move forward due to the user speeding up, the speed controller increases the motor speed to once again encourage the carriage to become centered. This feature allows the user to exercise at whatever pace he desires, including the ability to speed up or slow down without making any adjustments to the machine.

For illustration purposes, the principles of the present invention have been and will continue to be shown and described as they relate to particular preferred embodiments of exercise apparatus and the like. However, it will be understood that these principles are in no way deemed to be limited to such described embodiments. In fact, it will be further understood that these principles will apply to any form of human propelled motion machines.

Figure 13:
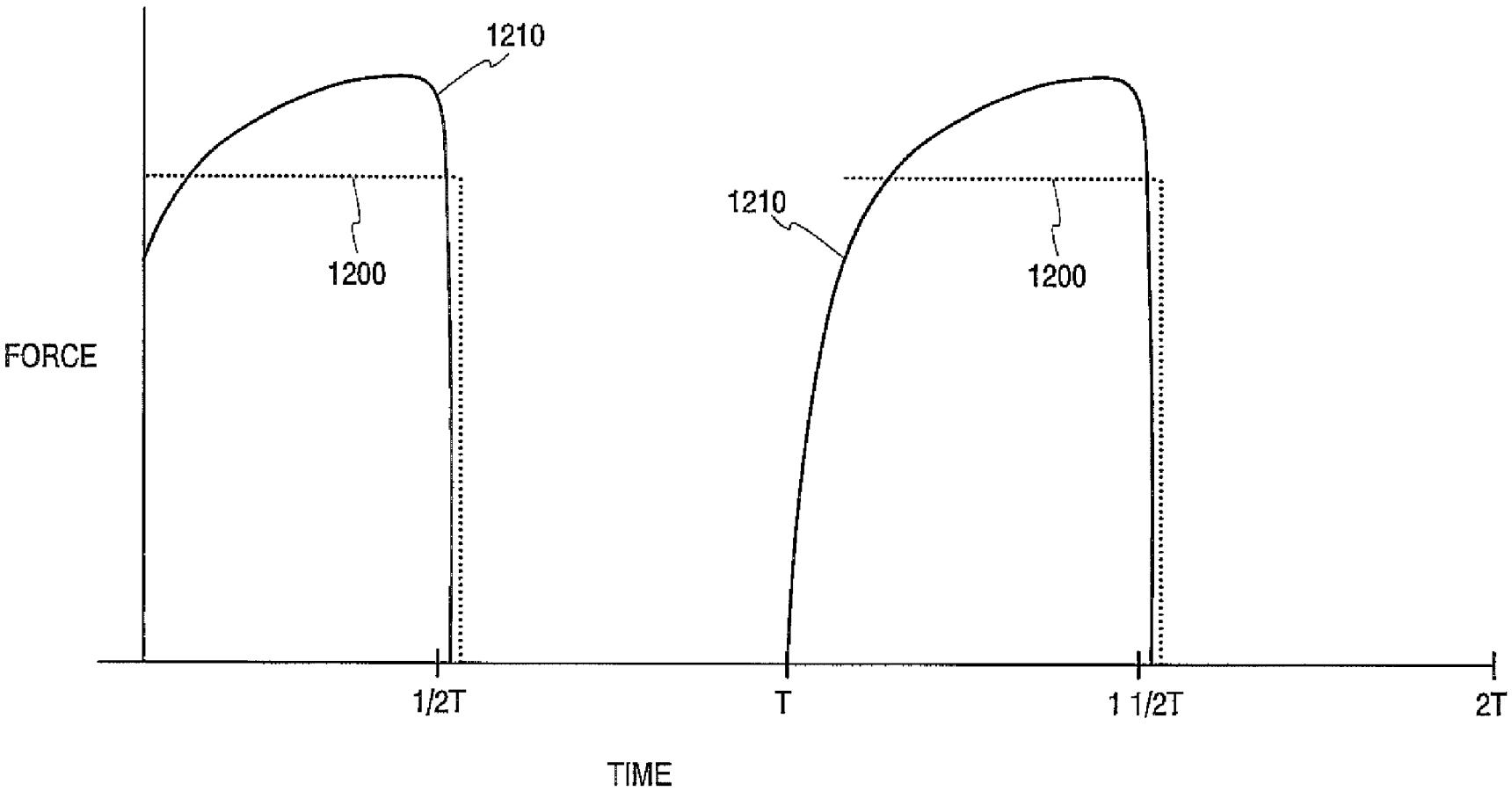
FIG. 13 is a chart depicting the force exerted by a user's foot on a bicycle pedal over time.

Referring now back to FIG. 13, the force between a user's foot and a pedal on both a stationary exercise bike (dashed lines) 1200 and a non-stationary bike (solid lines) 1210 while in use are shown. Note that Force is represented on the y-axis and time (with T=one full pedal revolution) is represented on the x-axis. With respect to the non-stationary bike (i.e. a real bike or a bike incorporating the present invention) 1210, as the user begins his stroke, the bike accelerates forward in a manner such that the force on the pedal increases as the stroke progresses. On the other hand and with respect to the stationary bike 1200, as the user begins his stroke, he encounters the rotating flywheel. However, because of the stationary nature of the machine his full force is translated directly to the flywheel. As the flywheel will resist any change in angular momentum, the force on the user's foot will be high and constant from the beginning to the end of the stroke.

Therefore, the graph of FIG. 13 demonstrates that for a given perceived force output, the user of a non-stationary bike will exert a greater net force while experiencing less stress to the joints and muscles of the leg as compared to the user of a stationary bike. Thus, the forces with respect to the non-stationary bike are healthier for the body's joints and muscles. This becomes particularly important when the present invention is incorporated within applications involving physical therapy where it is crucial to reduce the impact of force on recuperating bodies.

Figure 14:
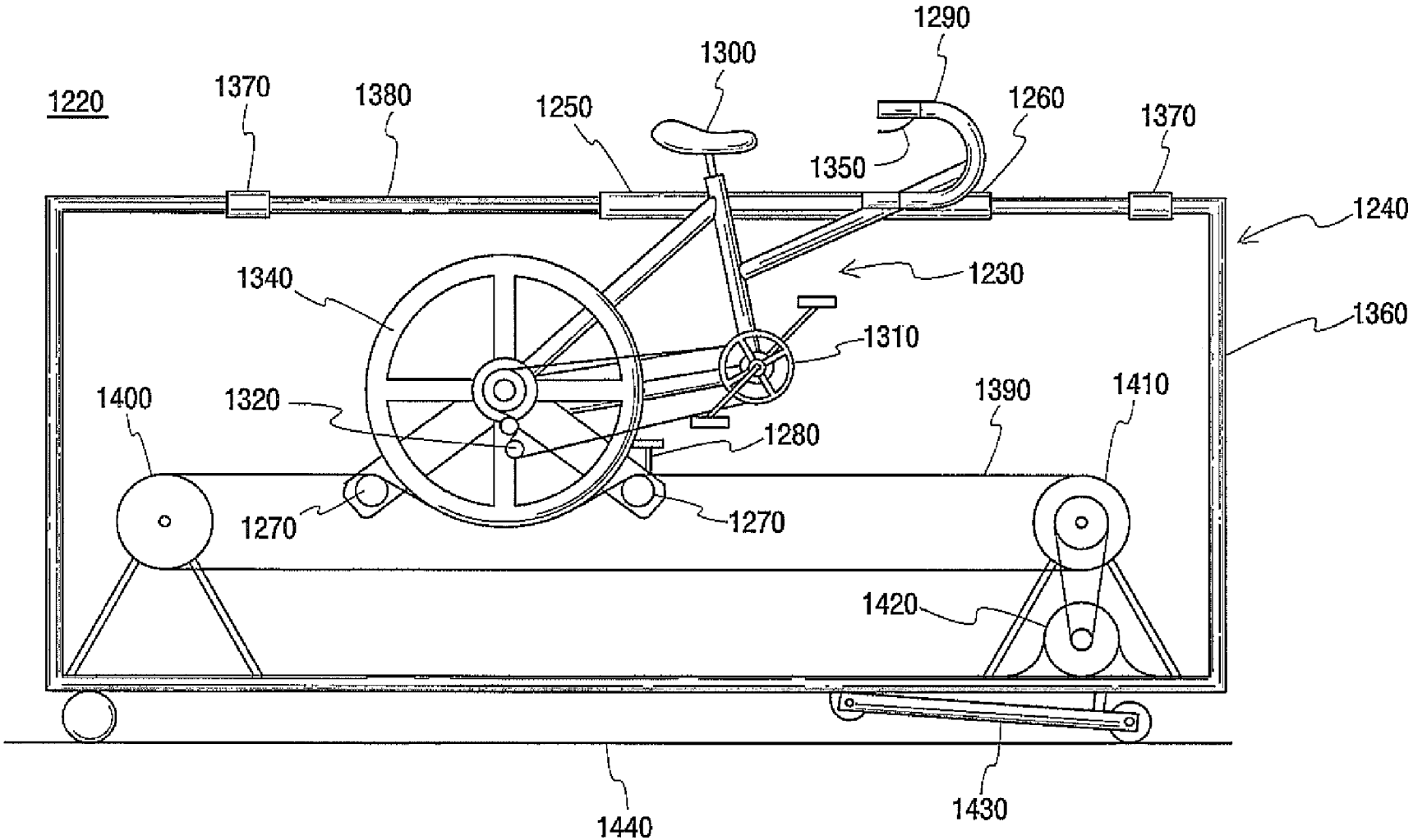
FIG. 14 is a side elevational view, partially in cross-section, of a preferred embodiment of a bike machine constructed in accordance with the principles of the present invention with its transmission on the carriage.

FIG. 14 illustrates one of the preferred embodiments of the present invention. This bike machine 1220 embodiment can be broken down into two main assemblies, the user carriage assembly 1230 and the support assembly 1240. The user carriage consists of a frame 1250 upon which is mounted a slide bearing 1260, a pair of idlers 1270, a drive element tensioner 1280 which adjusts rearward force on the carriage, and the typical bicycle components including a handle bar 1290, seat 1300, crank set 1310, derailleur 1320, drive wheel 1340 and gear shift 1350. The support 1240 consists of a frame 1360, a pair of stops 1370, a slide bearing rail 1380, a drive element 1390, drive element idler 1400, drive element drive wheel 1410, motor 1420 and an incline mechanism 1430 to provide for an adjustable positioning of the support 1240 and carriage assembly 1230 above a support surface 1440.

The carriage assembly 1230 is slidably mounted on the support assembly 1240 via slide bearing 1260 over bearing rail 1380. It is preferred that such a bearing combination be chosen such that with a user's full body weight on the carriage 1230, the carriage 1230 fore and aft friction is minimal. Although there are many types of bearing systems that will allow the carriage to freely move in the fore and aft directions, the preferred embodiment depicts a slide rail design. Other designs may include ball bearings, roller bearings, Teflon™ bearings, magnetic levitation, fluid bearings, etc. Additional features of the bearing system might include a certain amount of flexibility so that as the user exerts force to motivate the carriage, a certain amount of "give" is present to absorb some of the shock. Also, the design may allow for side to side or up and down motion in order to better simulate, for example, the side-to-side motion encountered when riding a bicycle or the up and down sensation of hitting a bump. This may include the ability to steer the carriage 1230 left and right within the confines of the support assembly 1240.

Stops 1370 are placed on the front and back of the slide bearing rail 1380 to keep the carriage assembly 1230 within the usable fore/aft range of the bike machine 1220. Preferably, these stops 1370 will incorporate spring means to avoid abrupt stopping when the user reaches the front or back of the machine. The stops 1370 can be spaced apart such that the carriage moves as little as a few inches between stops. However, the greater the distance, the more pleasurable the exercise experience will be to the user as a greater distance will allow for the ability to coast and rest between pedal strokes without being driven to the back of the machine The carriage assembly 1230 has a drive train consisting of a standard bicycle crankset 1310 which drives the drive wheel 1340 and is preferably capable of using various gear ratios through the use of derailleur 1320. In order to properly simulate real bicycle riding it is important that the angular momentum of the drive wheel 1340 be equivalent to the angular momentum carried by a normal bicycle which would be equivalent to the sum of the angular momentum of the front wheel and the back wheel. Additionally, it is also important that the weight of the carriage 1230 be approximately the same as that of a normal bicycle.

Motor 1420 drives drive element 1390 which engages drive wheel 1340 and is aligned by idlers 1270. This drive element can be a rubber belt, a bicycle chain, a cable, etc. To properly simulate real bike riding, the motor should be able to convey the drive element from 0 to approximately 40 mph. In order to maintain a uniform speed during exercise, the motor should be chosen such that it is powerful enough to compensate for the constant cyclic action of the carriage. This can also be accomplished by giving a large amount of momentum to the drive elements by, for example, adding a flywheel to the motor.

Idlers 1270 hold the drive element 1390 against the drive wheel 1340. The friction between the drive element 1390 and the drive wheel 1340 is crucial in simulating the feel of a real bicycle riding. To properly calibrate this friction, the pressure of the idlers 1270 is set so that the rearward force applied to the carriage by the drive element at a given speed is equivalent to the rearward force applied to a real bicycle and idler at the same speed as the result of wind resistance and friction between the road and the tires. Alternatively, a fixed rearward (or forward when operated in reverse) force can be applied to the carriage such as with a spring or a hanging weight.

In operation, the user mounts the carriage assembly 1230 and turns on the motor 1420 to the desired speed and direction (as the present invention allows user propulsion of the carriage in either forward or backward direction). If the user does not pedal, the carriage assembly 1230 will be propelled to the back of the rail 1380 against the back stop 1370. As the user begins to pedal and the drive wheel 1340 reaches and exceeds the speed of the drive element, the carriage and user will begin to move forward. The goal of the user is to keep the carriage centered on the support assembly 1240.

By increasing or decreasing the motor 1420 speed, the user can vary the intensity of his workout. The user can also vary the pressure on the drive wheel tensioner 1280 to vary the intensity of his workout. By reducing resistance, the machine will exhibit the same characteristics as a racing bike with thin, slick, high-pressure-tires. On the other hand, increasing the resistance will make the machine exhibit the characteristics of a mountain bike with wide, knobby, low-pressure tires.

Preferably, the user can simulate hill riding (both up and down) with the use of incline/decline mechanism 1430. This mechanism tilts the entire machine 1220 with respect to the support surface 1440 and creates an incline/decline plane against which to exercise. Additionally, by including the derailleur 1320, the user can change gear ratios between the crankset 1310 and drive wheel 1340. This allows the user to maintain a steady cadence (pedal strokes per minute) over varying motor speeds and hill incline/decline.

Figure 15:
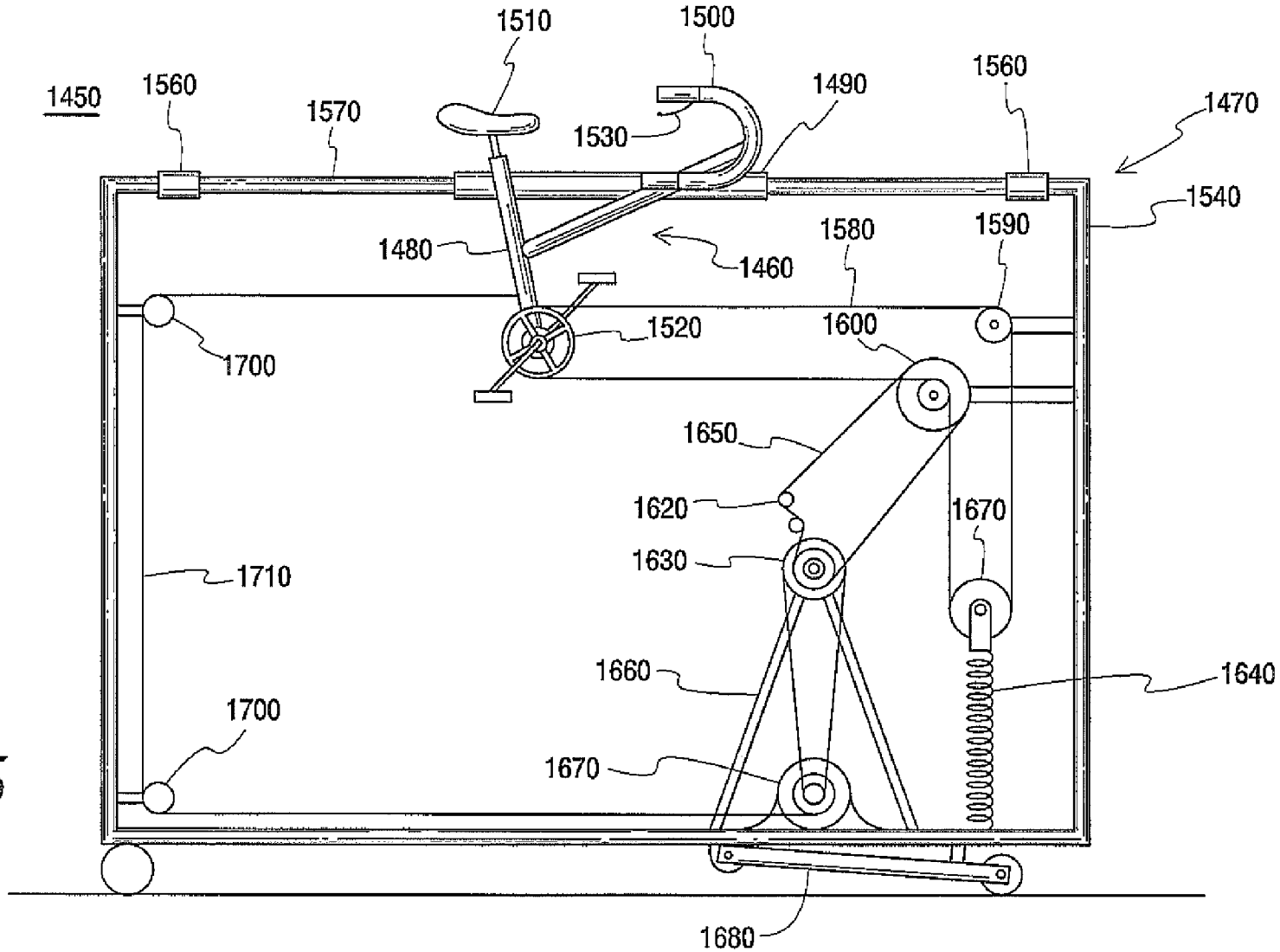
FIG. 15 is a side elevational view, partially in cross-section, of a preferred embodiment of a bike machine constructed in accordance with the principles of the present invention with its transmission on the support.

FIG. 15 illustrates another preferred embodiment of the present invention. Once again, this bike machine 1450 embodiment can be broken down into two main assemblies, the user carriage assembly 1460 and the support assembly 1470. The user carriage 1460 consists of a frame 1480 upon which is mounted a slide bearing 1490 and the typical bicycle components including a handlebar 1500, seat 1510, crank set 1520 and gear shifter 1530. The support assembly 1470 consists of a rigid frame 1540, a pair of stops 1560, a slide bearing rail 1570, a drive element 1580, drive element idler 1590, drive element drive wheel 1600, tensioner idler 1610, derailleur 1620, multigear sprocket 1630, tensioning springs 1640, transfer drive element 1650, motor drive element 1660, motor 1670, incline/decline mechanism 1680, friction element 1690, friction element idlers 1700 and friction element tether 1710.

The carriage assembly 1460 is slidably mounted to the frame assembly 1470 via slide bearing rail 1570. As previously discussed, the bearing combination is preferably chosen such that with the user's full body weight on the carriage 1460, the carriage fore and aft friction is minimal. This fore and aft motion is kept between a controlled range as defined by stops 1560. These stops would preferably incorporate spring means or the like to avoid abrupt stopping when the user carriage reaches the front or back of the machine 1450.

The crank set 1520 drives drive element 1580 which is preferably a bicycle chain, belt, cable, etc. Drive element 1580 passes over idler 1590, around tensioner idler 1610 and over drive element drive wheel 1600. Tensioning spring 1640 allows the carriage assembly 1460 to move freely fore and aft while maintaining constant tension on the drive element 1580. The larger diameter of the drive element drive wheel 1600 drives transfer element 1650 which is also preferably a bicycle chain, belt, cable, etc. This element 1650 passes through derailleur 1620 and around multigear sprocket 1630 (which is the equivalent to a multigear sprocket found on the rear wheel of a typical multi-speed bicycle). Parallel and directly attached to the multigear sprocket is a pulley which is driven by a motor 1670 and motor drive element 1660.

Additionally, friction element 1690 (also shown in FIG. 21) is also attached to the motor 1670. This device is a cylindrical spindle which free-wheels on the motor shaft with a certain amount of preferably adjustable friction. A friction element tether 1710 is wrapped around the friction element 1690 and runs through friction element idlers 1700 to attach to the back of the carriage frame 1480.

During operation, a user mounts the carriage 1460 and turns the motor 1670 on. As the motor spins, friction element 1690 applies a force to the friction element tether 1710 which pulls the carriage 1460 towards the back of the frame 1470. This friction increases with faster motor speed thereby urging the carriage backwards with greater force. As the user begins to pedal at a rate slightly faster than the rotation of drive element drive wheel 1600, the carriage 1460 will begin to move forward on the frame 1480. By operating gear shifter 1530, the user can vary the gear ratios on multi gear sprocket 1630, thereby simulating the various gear ratios on a multi-speed bicycle. In order to simulate hill riding, the incline/decline mechanism 1680 is adjusted accordingly.

Figure 16:
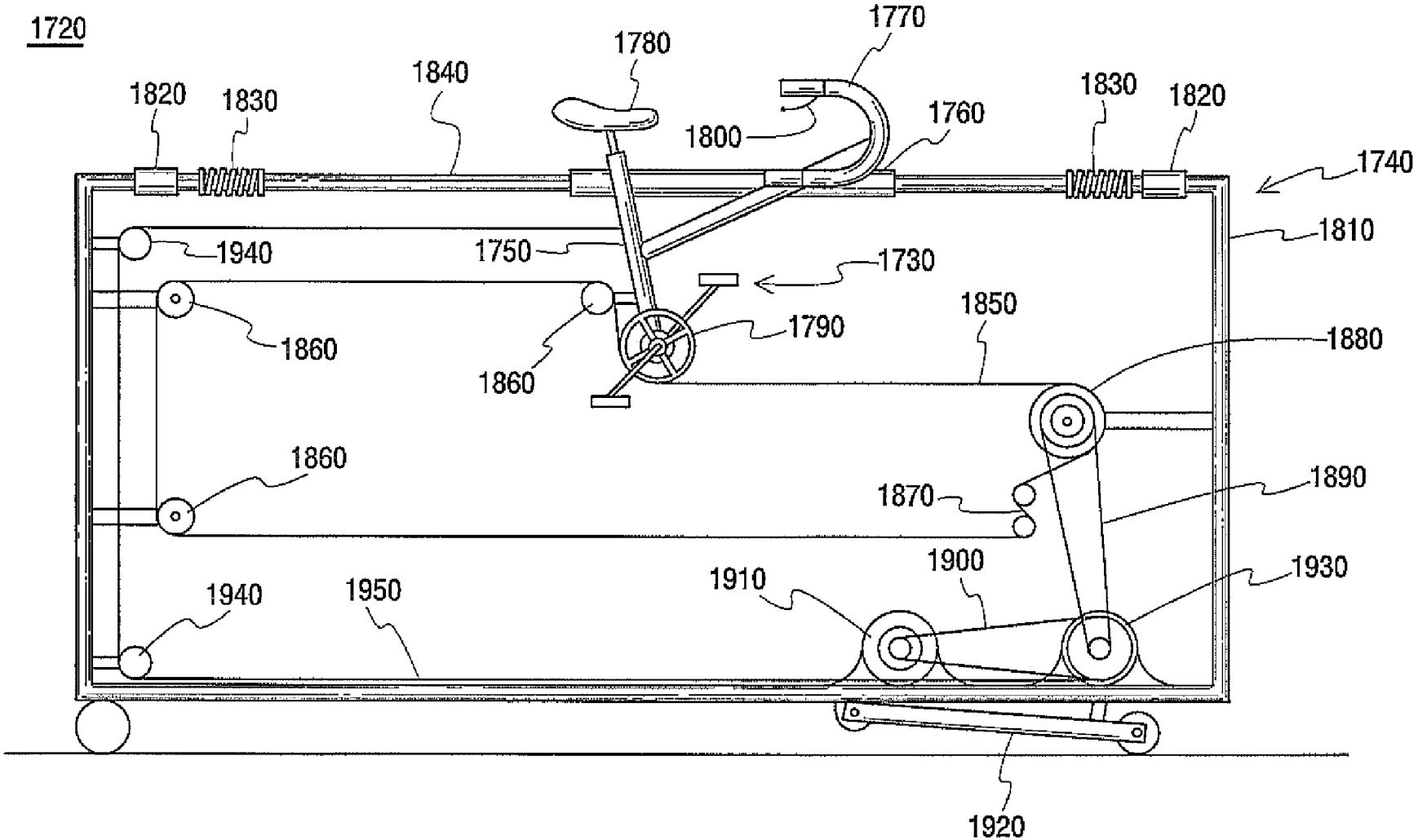
FIG. 16 is a side elevational view, partially in cross-section, of an alternate preferred embodiment of a bike machine constructed in accordance with the principles of the present invention with its transmission on the support.

The bike machine 1720 of FIG. 16 is much like the bike machine of FIG. 15, both of which have the transmission elements on the frame assembly. While many of the components of the bike machines of FIGS. 15 and 16 remain the same, their interconnecting has slightly changed. The bike machine 1720 of FIG. 15 includes the user carriage assembly 1730 and the support assembly 1740. The user carriage 1730 consists of a frame 1750 upon which is mounted a slide bearing 1760 and the typical bicycle components including a handlebar 1770, seat 1780, crank set 1790 and gear shifter 1800. The support assembly 1740 consists of a rigid frame 1810, a pair of stops 1820 (including springs 1830), a slide bearing rail 1840, a drive element 1850, drive element idlers 1860, derailleur 1870, multigear sprocket 1880, transfer drive element 1890, motor drive element 1900, motor 1910, incline/decline mechanism 1920, friction element 1930, friction element idlers 1940 and friction element tether 1950.

Figure 17:
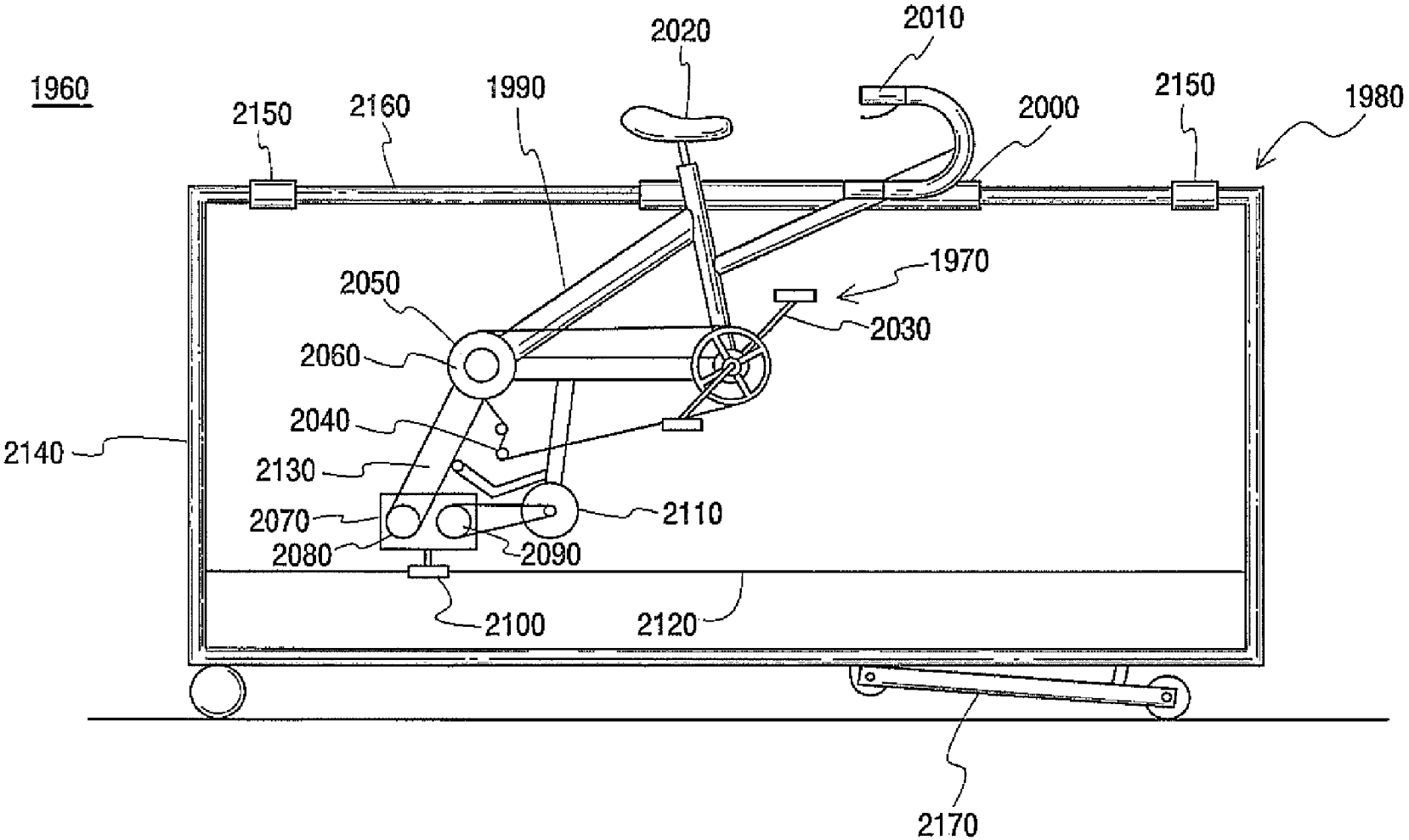
FIG. 17 is a side elevational view, partially in cross-section, of an alternate preferred embodiment of a bike machine constructed in accordance with the principles of the present invention with its motor and drive train in the carriage.

Yet another preferred embodiment of a bike machine incorporating the principles of the present invention is illustrated in FIG. 17. This bike machine 1960 has the same main components of a user carriage assembly 1970 and a support assembly 1980. The carriage 1970 consists of a frame 1990 upon which is mounted a slide bearing 2000, handlebar 2010, seat 2020, crank set 2030, derailleur 2040, crank set drive element 2050, sprocket set 2060 and differential gear set 2070. The differential gear set 2070 includes the carriage input 2080, motor input 2090, differential output 2100, motor 2110, differential drive element 2120 and variable friction device 2130. The support assembly 1980 consists of a rigid frame 2140, a pair of stops 2150, slide bearing rail 2160 and an incline/decline mechanism 2170.

The crank set 2030 drives the multigear sprocket 2060 thereby driving crank set drive element 2050 which is coupled to carriage input 2080 through variable friction device 2130. The motor 2110, preferably including a flywheel or the like, drives the motor input 2090. Differential output 2100 is a spindle with differential drive element 2120 wrapped around it and fastened to the front and back of the frame 2140.

It is preferable to incorporate an adjustable friction device 2130 at a point between crank set drive element 2050 and differential input 2080. Adding a resistance at this point will cause the machine to exhibit the same characteristics as riding a bicycle on the road as this friction will simulate the forces of road and wind friction.

During operation, the user mounts the carriage 1970 and turns the motor speed to the desired setting. As the motor begins to rotate input 2090, differential output 2100 will begin to turn thereby sliding the carriage assembly 1970 toward the rear of the machine. As the user begins to pedal, carriage input 2080 begins to rotate. As the user reaches a pedaling cadence such that element 2080 and element 2090 are rotating at equal rates, the carriage assembly will remain in a relatively steady fore and aft position. If the user momentarily stops pedaling, the drive element 2050 will begin to slow causing differential output 2100 to rotate and drive the carriage assembly 1970 backwards. On the other hand, if the user speeds up his pace such that the input 2080 rotates faster than input 2090, differential output 2100 will drive the carriage assembly 1970 forward. Obviously, and as discussed with respect to FIG. 13, as the user exerts effort on each stroke, the carriage assembly 1970 will oscillate fore and aft.

A variation of this embodiment can be operated without the use of a base frame. This can be done by replacing rail bearing 2000 and support assembly 1980 with wheels which allow the carriage to roll on a flat floor surface and driving the wheels with differential output 2100. During operation, the user would mount the machine, turn on the motor and pedal. If the user's speed is equal to that of the motor speed, the machine will stay in a relatively stationary location. If the user accelerates or decelerates, the machine will move forward or backward. Additionally, placing the machine on an incline or decline plane, hill riding can be simulated.

Although the bike machine embodiments of FIGS. 14-17 included incline/decline mechanisms to simulate hill riding, the slight elevation of those machines would enable further embodiments that would not need to be motorized. In other words, the dynamic member would be propelled by slightly elevating the front end of the machine and allowing the carriage to ride on an inclined plane. Referring back to FIG. 14, all of the components of this non-motorized embodiment would be the same as earlier described with the exception of motor 1420. The non-motorized version would instead include a flywheel with a braking means such as a friction band or a generator with a variable load.

During use, the front of the machine is slightly elevated and as the user begins to pedal, the carriage is propelled forward and slightly up due to the incline. Because of this incline, the tendency of the carriage will be to return towards the rear of the frame. If the user continues to pedal, the dynamic element 1390 will be traversing the drive wheel 1340, thereby rotating the flywheel (previously motor 1420). The rate of rotation of the flywheel can then be further controlled by various speed control methods.

Figure 18:
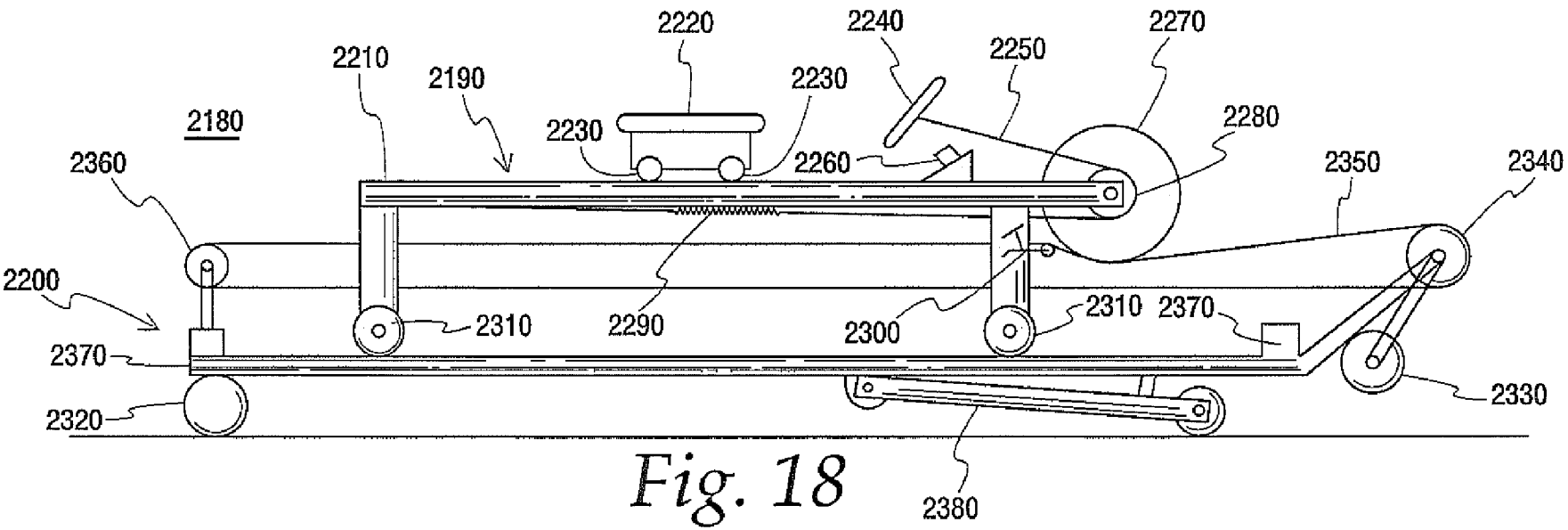
FIG. 18 is a side elevational view, partially in cross-section, of a preferred embodiment of a rowing machine constructed in accordance with the principles of the present invention.

The human propelled differential motion machine of the present invention may also be utilized to simulate rowing. The preferred embodiment of such a rowing machine 2180 consists of a carriage assembly 2190 and a base support assembly 2200 and is illustrated in FIG. 18. The carriage assembly 2190 consists of a frame 2210, a seat 2220 and rollers 2230, which allow the seat 2220 to freely slide fore and aft on the frame 2210. The carriage further includes pull handle 2240 (attached to drive chain 2250), foot support 2260, drive wheel 2270, one way drive clutch 2280, recoil spring 2290, friction device 2300 and carriage wheels 2310. The base support consists of a frame 2320, motor 2330, drive element drive 2340, drive element 2350, idler 2360, stops 2370 and incline/decline mechanism 2380.

To operate, the user sets the motor speed to the desired level. The motor 2330 then drives element 2350 which engages drive wheel 2270 and friction device 2300 causing the carriage assembly 2190 to move toward the back of the machine 2180. The user then sits on the seat 2220 and secures his feet into the foot supports 2260. While bending his knees, the user grasps pull handle 2240 and begins a rowing motion which involves straightening his knees and pulling with his arms. As the user pulls on the handle, drive chain 2250 engages one way clutch 2280 and rotates drive wheel 2270. When the user reaches the end of his stroke, he bends his knees again and allows the recoil spring 2290 to retract the drive chain over the one way clutch in the freewheel direction. When the drive wheel 2270 exceeds the speed of drive element 2350, the carriage assembly 2210 begins to move towards the front of the machine 2180.

Figure 19:
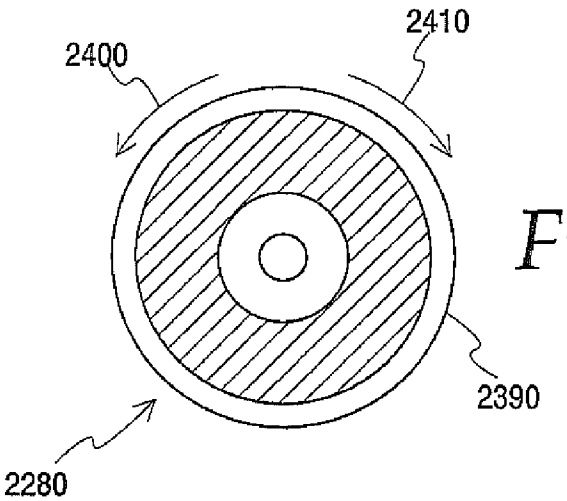
FIG. 19 is a side elevational view of the one-way clutch mechanism of FIG. 18.

FIG. 19 is illustrative of an enlarged view of the one way clutch mechanism 2280 of FIG. 18. The drive chain engages the mechanism about its outer circumference 2390 and upon the power stroke rotates counterclockwise 2400. If this counterclockwise rotation is greater than the drive wheel 2270 rotation, the clutch engages the drive wheel and urges the carriage assembly 2190 forward. If this counterclockwise rotation is not greater than the drive wheel 2270 rotation or the clutch 2330 is rotating clockwise 2410 as during the rest stroke, it will be disengaged from the drive wheel 2270 and the carriage assembly 2190 is urged backwards due to the deceleration of the drive wheel 2270 relative to the drive element 2350.

The user's goal with this rowing machine 2180 is again to maintain an average position between the stops 2370. As he exercises, the carriage will travel forward during the power portion of his stroke and rearward during the rest portion. Additional to the upstream/downstream effect the incline/decline mechanism 2380 can offer, a multispeed derailleur mechanism may be added to the drive wheel 2270. This would allow the user to increase or decrease the amount of effort required for exercise. It may also be beneficial to make friction mechanism 2300 adjustable. This would give the user a different means for increasing or decreasing the effort required for exercise. By increasing resistance, the experience would be similar to rowing a heavy wooden rowboat. By decreasing the resistance, the experience would be similar to rowing a light weight crew shell. By further reducing the resistance and increasing the gear ratio of the drive system, this machine can allow the user to exercise at a much greater speed than otherwise possible.

The present invention has thus far been described as it relates to a preferred skier embodiment, a preferred bicycle embodiment as well as a preferred rower embodiment. Other human motion simulating machines may be easily designed according to the principles described herein and as such would realistically exhibit the sensation of natural motion. However, rather than describing infinitive machines, the more general design characteristics that may be incorporated within any embodiment will now be discussed.

For example, an important design characteristic of the carriage is the consideration of the momentum exhibited thereby. When using the invention for bicycle riding, for example, in order to properly simulate the ride, the carriage should weigh approximately the same as a standard bicycle so that as it oscillates fore and aft, it will exhibit the same characteristics of a real bicycle. Additionally, the angular momentum carried by the rotating components of the carriage should be equivalent to those on a real bicycle, namely the angular momentum of the bicycle wheels.

A carriage used for simulating bicycle riding will generally use two pedals to drive the system and as such would be considered to be a two way dependant motion system which means that as one pedal is pushed down, the other necessarily comes up, i.e., the motion of one pedal is dependant upon the other. Other human propelled activities may use four way independent motion to propel the user, such as for example, cross-country skiing. In such a situation, the user can propel himself with one limb, or any combination of limbs without depending on the others. In order to properly simulate these, as well as other motions, the carriage can be designed to allow for dependent and/or independent motion.

Figure 20:
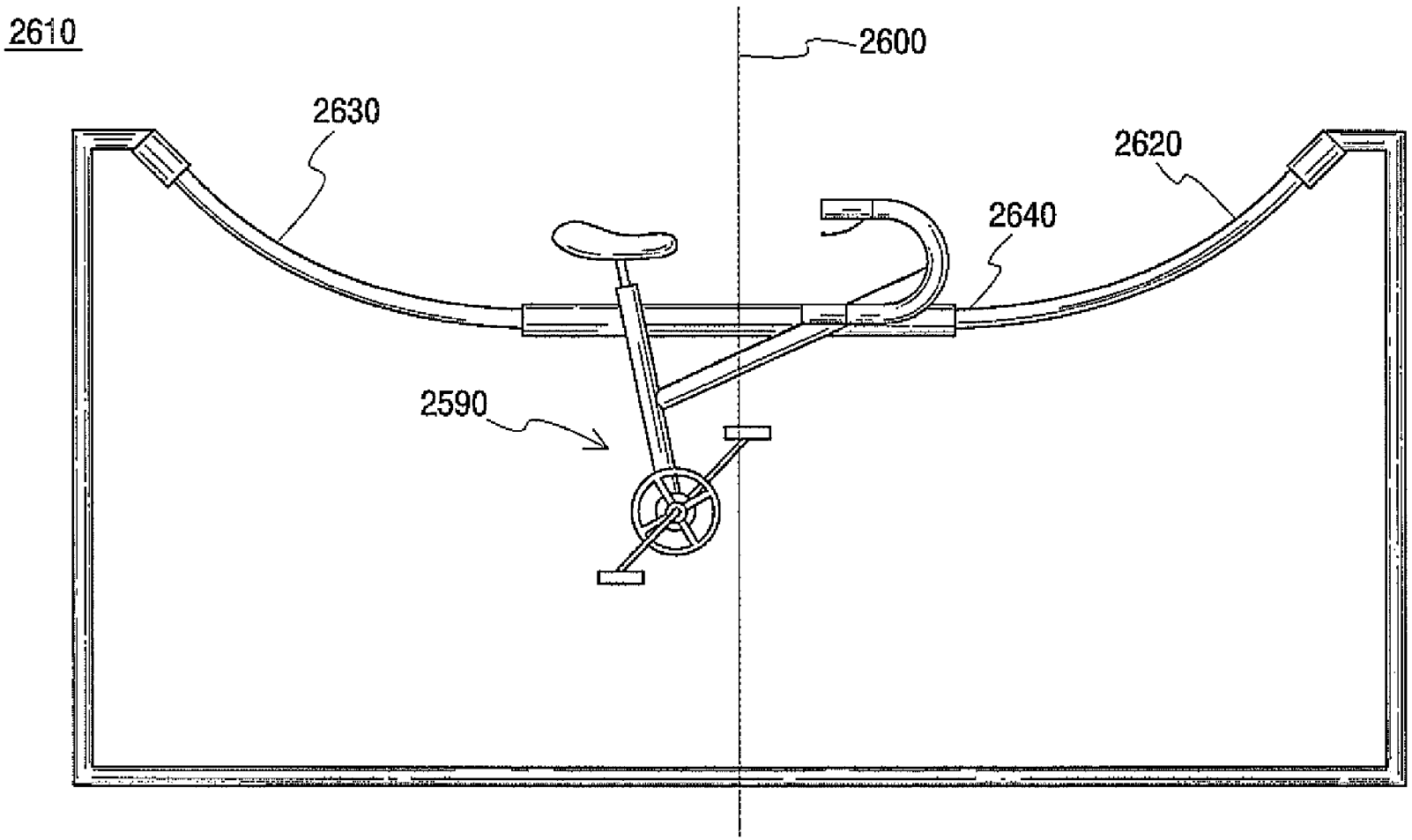
FIG. 20 is a side elevational view, partially in cross-section, of an alternate preferred embodiment of a carriage path of a bike machine constructed in accordance with the principles of the present invention.

In order to simulate, for example, bicycle riding, it is important that the carriage is allowed to travel a somewhat linear path. Referring now to FIG. 20, since the goal of the user is to maintain the position of the carriage 2590 in roughly the middle 2600 of the machine 2610, it may be desirable to use a non-linear path for the carriage slide system such that the front 2620 and rear 2630 of the path are slightly higher than the middle 2640. This way, as the carriage is moved off center, it is encouraged to return to the lowest point on the path, i.e., the middle. This would allow the invention to be built on a shorter frame since the total fore and aft travel will be reduced.

Alternatively, it may be desirable to build a long track for the carriage. Such a design would be particularly beneficial when using multiple machines, side by side, for competition. It may also be beneficial to incorporate a long track with an inclined or declined portion so that, for example, when a user wishes to simulate riding uphill, he moves the carriage to the inclined section of the track.

Another important design characteristic is the amount of rearward force applied to carriage, or forward force when the invention is being used in reverse. On a bicycle, for example, this force is the equivalent to the rearward force applied to a moving bicycle due to wind resistance as well as the resistance between the bicycle tires and the road. The characteristics of this force may vary based on the resistance of the tires on the road, the speed of the bicycle over the road, air resistance, the rider's weight and the momentum of his legs during his pedal strokes. If the user applies a force equal and opposite in direction to this resistive or rearward force, the bicycle will travel at a constant velocity.

One method of providing rearward force is shown in FIG. 14. As dynamic member 1390 passes over idlers 1270 and drive wheel 1340, there is a certain amount of friction between these elements resulting in the tendency of the dynamic member 1390 to motivate the carriage assembly 1230 in a rearward direction. Idlers 1270 may be adjustable such that they apply greater or lesser pressure against the dynamic member 1390. Another method for providing rearward force is to apply a braking pressure against one of idlers 1270 as demonstrated by the footcar of FIG. 6.

Figure 21:
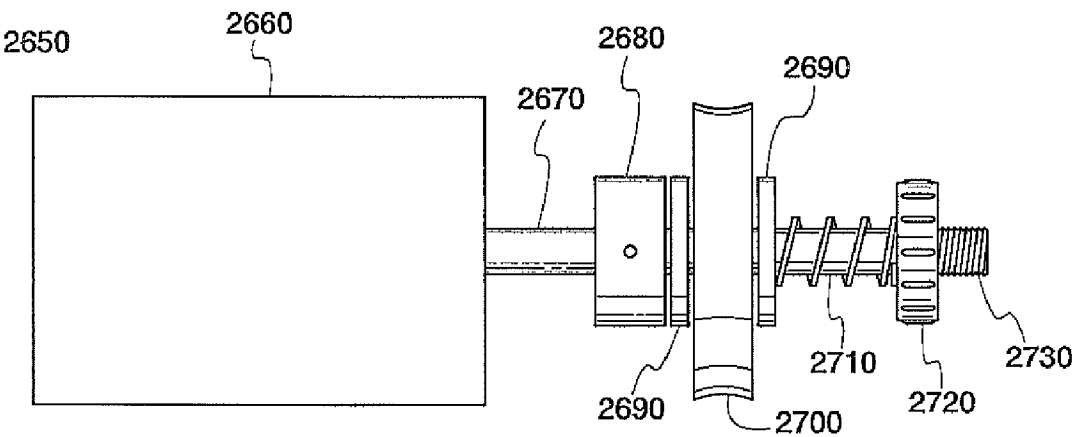
FIG. 21 is a front embodiment view of the variable dynamic friction element of FIGS. 15 and 16.
Figure 23:
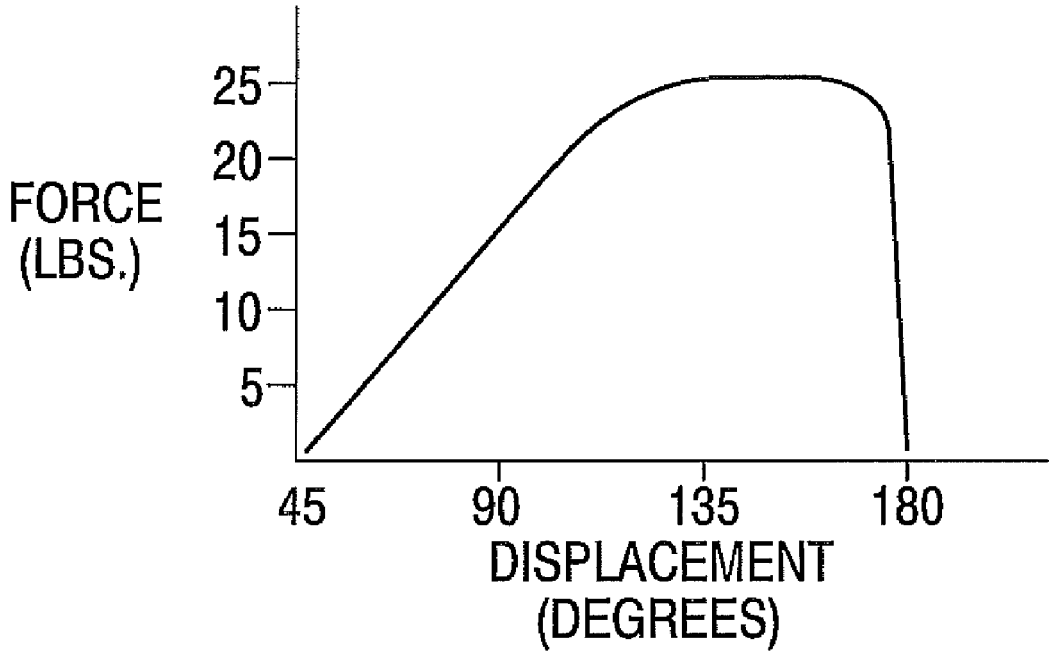
FIG. 23 is a chart depicting the force vs. displacement for healthy triceps exertion.
Figure 24:
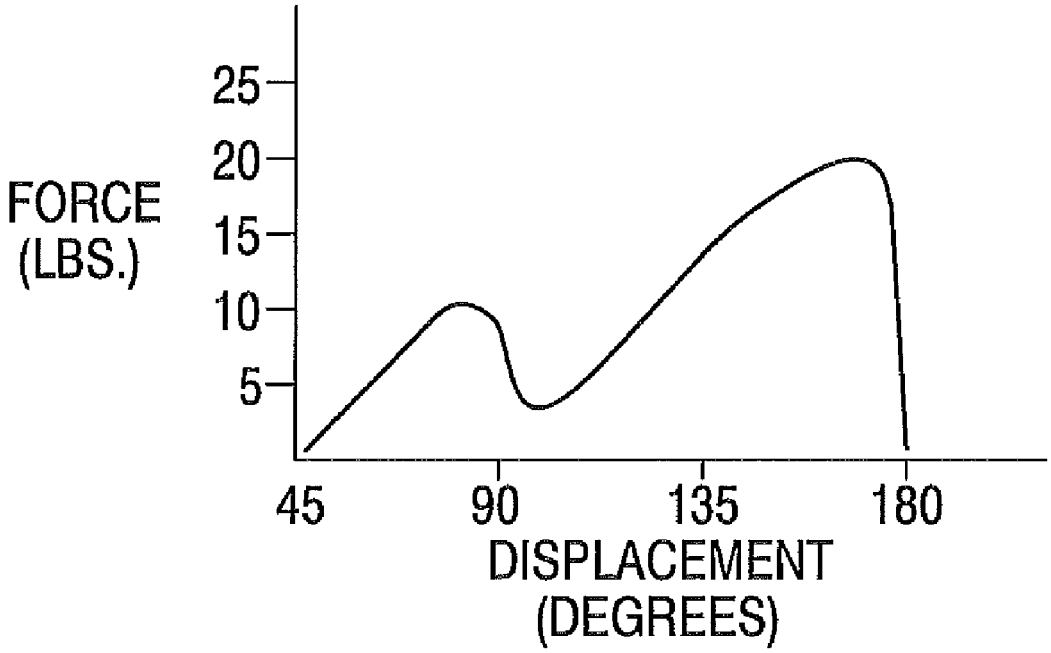
FIG. 24 is a chart depicting the force vs. displacement for injured triceps exertion.
Figure 25:
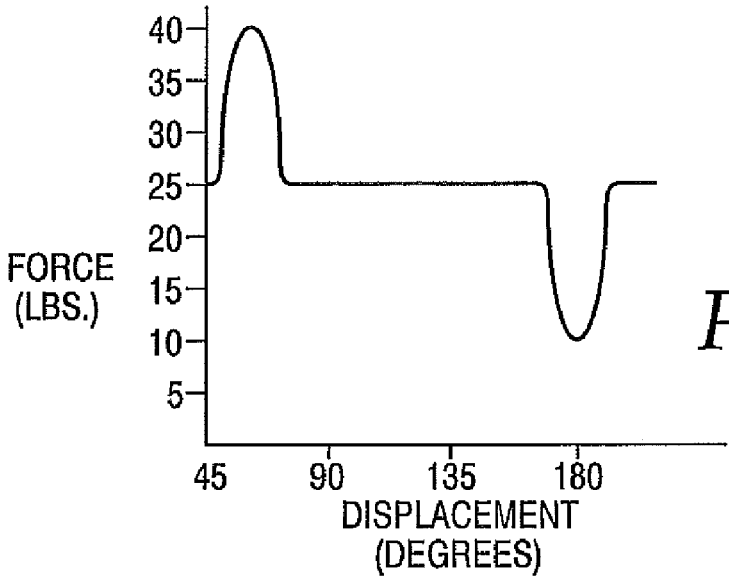
FIG. 25 is a chart depicting the force vs. displacement for weight bearing triceps exercise.
Figure 26:
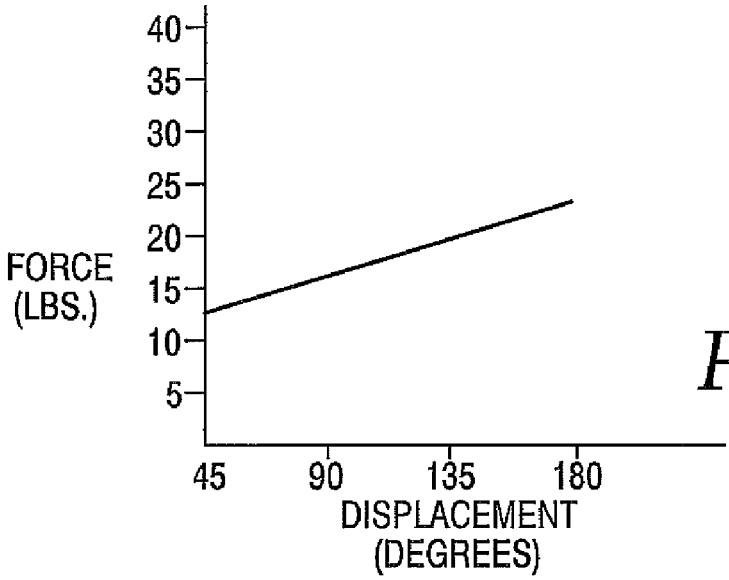
FIG. 26 is a chart depicting the force vs. displacement for spring bearing triceps exercise.
Figure 27:
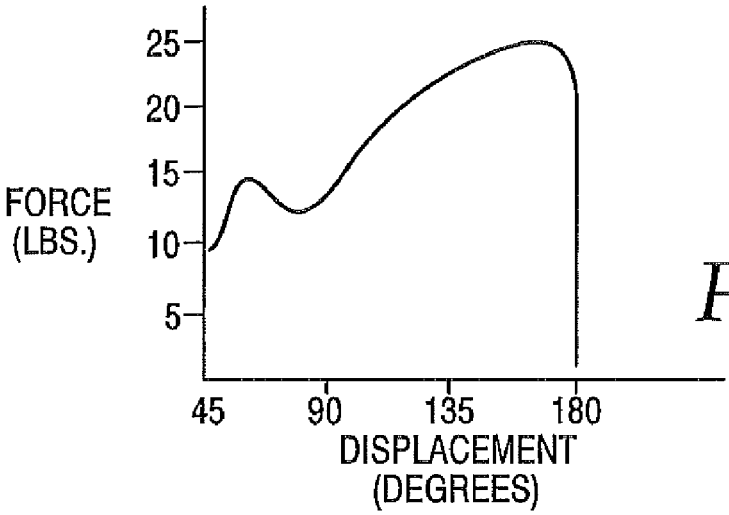
FIG. 27 is a chart depicting the force vs. displacement for flywheel/resistance triceps exercise.

Another method used in the present invention is demonstrated in FIG. 21. This shows a variable dynamic friction element 2650 which can be added to the motor, or the moving device in the non-motorized version. It consists of a motor 2660, or other moving device in the case of a non-motorized version, drive shaft 2670, fixed coupling 2680, friction pads 2690, spindle 2700, spring 2710 and a threaded knob adjuster 2720, which mates with motor or moving device shaft threads 2730.

In order to accurately exhibit the force characteristics found in nature, the diameter of the spindle 2700 must be chosen so that if it were allowed to spin at the same rate as the motor shaft, its surface speed would be equivalent to the speed the machine is simulating. In operation, a tether is wrapped around spindle 2700 and attached to the rear of the carriage assembly such that as the spindle turns in the direction of the motor shaft, the tether applies a force to the carriage in a rearward direction. As the motor rotates faster, the spindle 2700 applies increasing rearward force to the carriage. By adjusting knob 2720, the user can create more or less resistance allowing the machine to have the feel of, for example, a mountain bike with low-pressure tires (high resistance) or a racing bike with high-pressure tires (low resistance).

Figure 22:
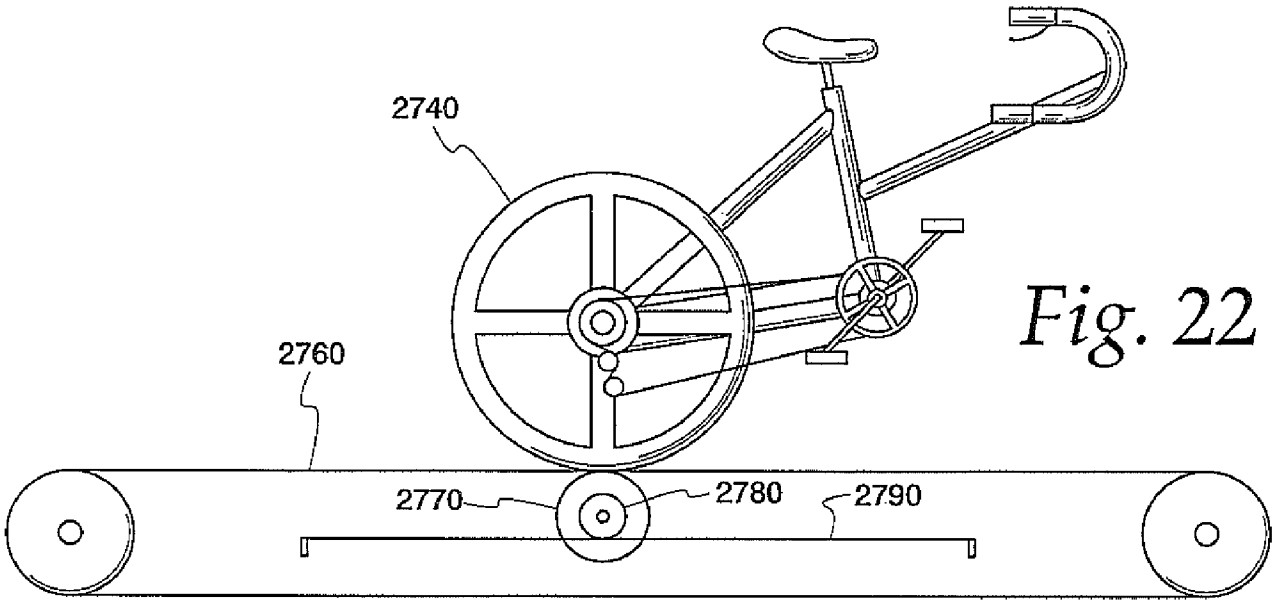
FIG. 22 is a side elevational view of a weight dependent friction method for use with the preferred embodiments of FIGS. 14, 15 and 17.

FIG. 22 shows another rearward force method which is variable upon the user (and carriage) weight. It consists of a drive wheel 2740, drive element 2760, idler wheel 2770, roller bearing 2780 and roller bearing rail 2790. This method basically involves the replacement of bearing 1260 and rail 1380 of FIG. 14 with rolling bearing 2780 and roller rail 2790, and replacing idlers 1270 from FIG. 14 with idler wheel 2770.

As the user mounts the carriage 1230, his weight (along with the weight of the carriage) forces drive wheel 2740 down against drive element 2760 and against idler 2770. The carriage 1230 is capable of rolling fore and aft on roller bearing 2780 and rail 2790. Drive wheel 2740 and idler 2770 are not fixed in location relative to one another, in other words, as the user mounts the carriage 1230, his weight causes wheel 2740 to compress drive element 2760 onto idler 2770. As a result, the greater the weight, the greater the force applied to the carriage.

Another method for applying rearward force involves using a generator mounted on the carriage designed to engage the dynamic element. For example, if friction element 1270 were replaced with a generator, a fixed or variable load can be placed across the generator to offer greater or lesser force against the dynamic element thereby driving the carriage in the direction of the dynamic element.

Another method for applying rearward force involves using a servo motor and a microprocessor or other control method. The servo motor is attached to the rear of the frame with a tether wrapped around its output shaft and attached to the carriage. The microprocessor directs the servo motor to apply a specified amount of force to the carriage. In this embodiment, it may be desirable to have the user enter his weight so that the microprocessor can accurately calculate the amount of force required.

It may be desirable to incorporate a strain gauge between the carriage and the rearward force device. This would allow for calibration of the invention and would also ensure that similar devices used for competition purposes would be equally matched.

It may also be desirable to simulate the forces caused by wind. For example, as a bicycle rider increases his speed, the apparent wind speed increases, thereby increasing the amount of rearward force on the bike. One way to simulate this effect is to incorporate a variable speed fan at the front of the machine. Another way is to calculate the force effects of wind and incorporate them into the force devices described above.

Another design characteristic involves the control of the speed of the dynamic element of the present invention. When using a motor to drive the dynamic element, a simple potentiometer can be used to adjust and control motor speed.

However, another method involves the use of an "intelligent" speed control system. This involves detecting the fore/aft position of the carriage and adjusting the speed of the dynamic element accordingly. The goal is to have the system speed up the dynamic member as the carriage approaches the front of the base, and slow down and eventually stop the dynamic member as the carriage approaches the back of the base. This way the user can "zone out" and not pay attention to his position on the machine. If he wishes to go faster, he simply speeds up his motions and the machine speeds up to match his pace. Conversely, as the user slows down, the machine slows down. If the user stops, the machine will stop before the carriage reaches the back of the base. This feature has tremendous value for allowing multiple users to compete with one another. The user can constantly change his pace without having to manually interface with the machine.

The goal of the speed control system is to keep the user roughly centered (fore and aft) on the machine. There may be times, however, when it is desirable to bring the user off center. For example, if it is desirable for the user to accelerate, it is best if he begins his acceleration from the back of the machine. As he accelerates, his position will move forward, and until he reaches the front stop, the invention will exhibit the exact characteristics of acceleration.

Detecting the fore/aft position of the carriage can be accomplished in many ways. One method involves the use of a sonic range sensor mounted at the front or rear of the machine. When aimed at the carriage, this device can detect the exact fore/aft location of the carriage and direct the motor speed accordingly. Another method involves running a tether from the carriage to a pulley on the back of the frame, then forward to a pulley on the front of the frame, then around a potentiometer, and back to the carriage. As the carriage moves fore and aft, the potentiometer increases and decreases the speed of the motor.

It may be desirable to allow the machine to be run in a program mode such that the user rides on a predetermined course shown on a display. In this case, the speed control system may automatically vary the speed of the dynamic element so as to change the fore/aft position of the user in anticipation of the user accelerating or decelerating. For example, if the program has a user riding up hill and approaching the top, the speed control system may speed up the dynamic element so that the carriage moves toward the back so that as the user reaches the top of the hill and the terrain becomes level, the user can accelerate without worrying about hitting the front stop.

Similar techniques can be applied toward the non-motorized versions of the invention. If a generator is used to control the dynamic element, a tachometer can be incorporated and used to control a variable load across the generator to maintain a constant speed. Similar to above, this system can also be made "intelligent". If a flywheel and friction band are used, a tether can be attached to the carriage to control pressure on the friction band such that as the carriage moves rearward, the friction increases, causing the flywheel to slow. Conversely as the carriage moves forward, the friction decreases causing the flywheel to speed up.

The present invention has been described as it relates to human motion simulating machines. Specifically, these have included, for example, skier machines, walking machines, climbing machines, rower machines and bicycle machines. Generally, these machines embody a means capable of allowing a user to traverse between ends of a frame wherein as the user is urged in one direction he propels himself in the opposite direction.

Turning now to the strength training attributes of the present invention, it will be appreciated that the previously discussed speed controlled motor will again be utilized. More particularly, the present invention includes at least one speed controlled motor which rotates a drive shaft. Mounted on the drive shaft is at least one one-way clutch spindle and recoil system. A flexible member such as a rope, cable, or belt engages the spindle which engages the one-way clutch such that when the flexible member is pulled, it spins the spindle in the direction of the drive shaft rotation locking the one-way clutch such that the spindle can spin only as fast as the rotating drive shaft. When the flexible member is released, the recoil mechanism causes the spindle to spin in the opposite direction, which releases the one-way clutch and recoils the flexible member.

As the user pulls on the flexible member and engages the one way clutch, he is restricted to pulling no faster than the rotational speed of the drive shaft will allow. For this reason it is necessary to maintain a tightly controlled motor speed. When the user is not pulling on the flexible member (rest stroke), the motor drives the drive shaft, however when the user pulls the flexible member (power stroke) with enough force to overcome internal resistance, he applies power to the drive shaft at which point a braking force is applied in order to keep the drive shaft from accelerating. This braking force varies depending on the amount of force applied by the user.

Ideally, the overall speed of the motor can be adjusted to allow for higher or lower intensity workouts. Once a speed is selected, maintaining a relatively constant driveshaft RPM is necessary. When a poor speed controller is used and the motor speed varies by more than approximately 10%, the quality of the exercise is diminished because a portion of the user's work is dissipated by accelerating the drive shaft. This "dissipated" work adds a dull sensation to the user's experience. A 2 hp. dc motor powered by a 2 quad drive such as the 12M8-22001 by Gemini Controls works well for this application. Additionally, a flywheel will help maintain a uniform speed.

Prior art machines using a pull rope on a rotating shaft have relied on resistance means whereby torque is speed dependent. In other words, the faster the user pulls, the harder the resistance becomes. This acceleration reduces the ability of the user to exert a greater amount of force at the end of the stroke. In one embodiment, the present invention constantly adjusts torque to the system to allow for a constant speed such that only the torque changes as the user pulls harder or softer.

By adjusting the motor speed, the perceived amount of effort can be altered. A slower speed generally feels more difficult than a faster speed. It may be desirable to give a greater perceived difficulty at the end of the user's stroke when he can produce the most power. For example, the motor speed can be automatically slowed while the user exercises through his range of motion. This can also be accomplished by using a rope as a flexible member and wrapping it around a conical shaped spindle. When the rope is pulled it is retracted from a larger diameter to a smaller diameter thereby slowing in speed as it is retracted. Another method involves using a flat belt as the flexible member and wrapping it around a cylindrical spindle. When the belt is fully wound (upon itself), it is at a larger diameter than when it is fully unwound. By choosing different spindle diameters and belt thicknesses, various perceived force vs. range of motion profiles can be created.

In certain instances, it may be desirable to allow for the setting of a maximum allowable force output. For example, a patient recovering from an elbow operation may be advised to lift no more than 10 pounds. The present invention can be programmed to allow for an increased motor speed when a predetermined maximum amount of force is applied. For example, a maximum braking load can be set for the motor speed controller such that motor speed increases once the maximum braking force has been applied.

Figure 28:
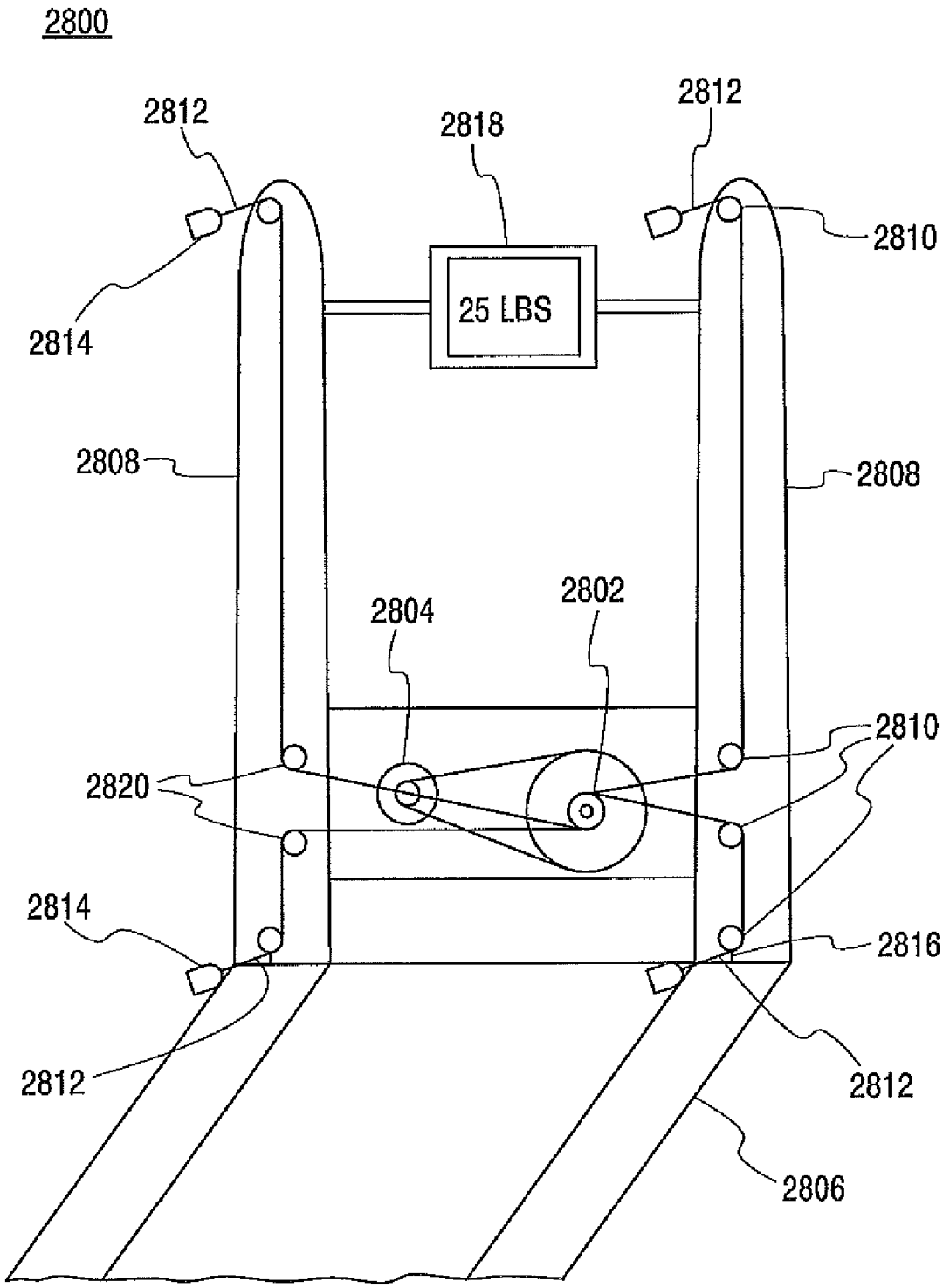
FIG. 28 is perspective view of a strength exercise apparatus according to one embodiment of the present invention.

In one embodiment, illustrated in FIG. 28, the strength machine 2800 includes four one-way clutch mechanisms 2802. The motor drive 2804 and clutch assemblies are mounted to a base frame 2806 which includes at least one upright member 2808. With the use of pulleys 2810, two flexible members 2812, are routed to the top of the upright member 2808, and two flexible members 2812 are routed to the bottom of the upright member 2808 or the base frame 2806. By attaching handles 2812 to the ends of the flexible members, various strength exercises can be performed.

By way of example, a user can exercise triceps by standing in front of the machine and pulling down on the upper handles. By reaching down and pulling up on the lower handles the user can exercise the biceps. When sitting in front of the machine the user can pull down on the upper handles to exercise the latissimus dorsi muscles, and by pushing up on the lower handles exercise the shoulders. Using a bench and lying down, the user can exercise back muscles with the upper handles, and chest with the lower handles.

Figure 29:
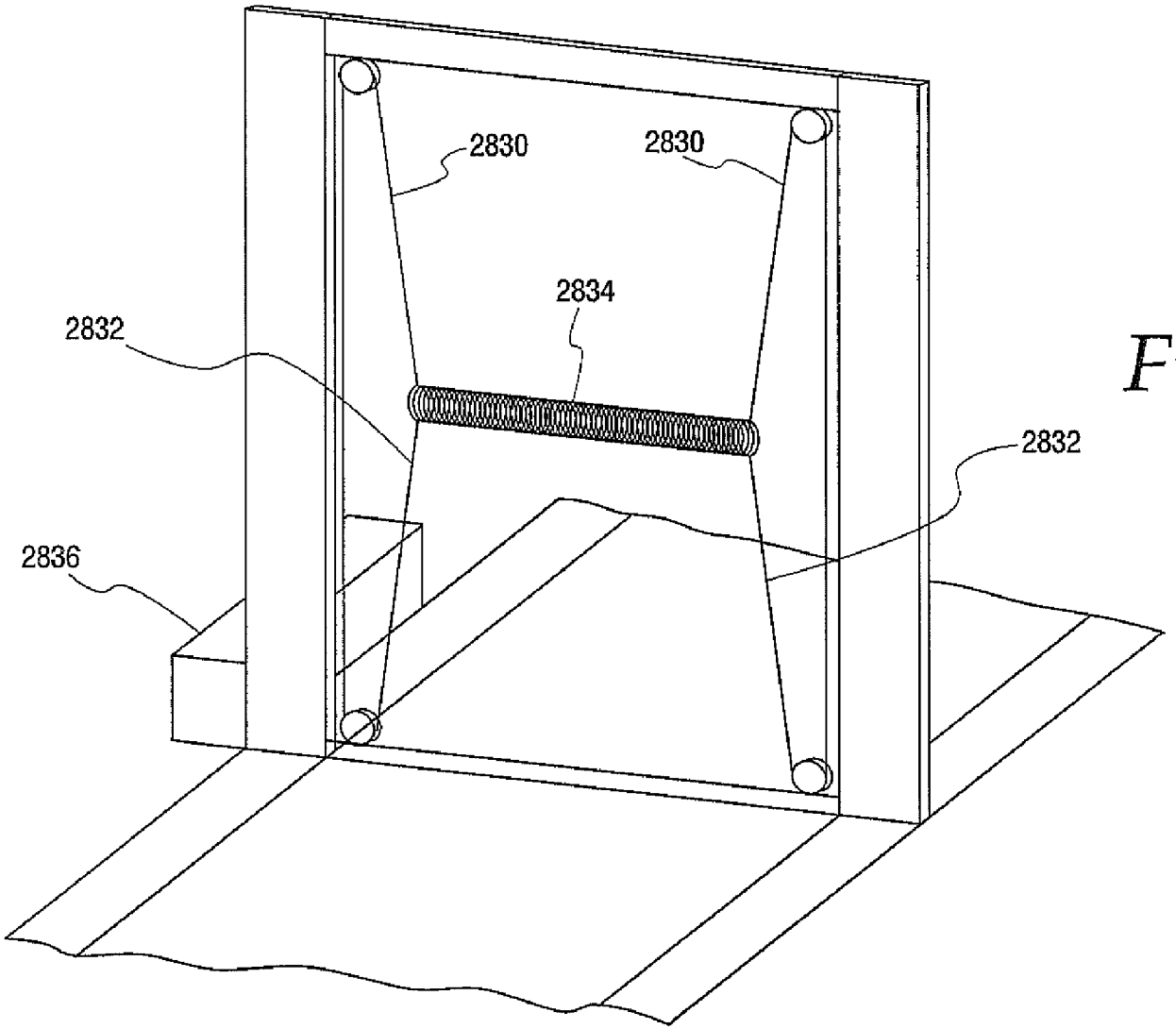
FIG. 29 is a perspective view of a strength exercise apparatus according to another embodiment of the present invention.

The strength machine can be adaptable to be able to utilize opposing flexible members to enable the user to exercise opposing muscle groups simultaneously (within the same exercise set). More particularly, and as the embodiment shown in FIG. 29 illustrates, at least two pull ropes are attached at the handle end. Here, two upper pulley ropes 2830 are attached to two lower pulley ropes 2832 at a common bar 2834. This allows the user to exercise two opposing muscle groups within the same cycle. For example, the user can grasp the bar and do a biceps curl, and when he reaches full flexion, he can rotate his hand grip and do a triceps push down. This feature makes the present invention more time productive than other strength training techniques. The user can also push the bar horizontally and exercise chest muscles, or pull the bar horizontally to exercise back muscles. Because the ropes will pay out at a fixed speed, the projectile of the bar will be guided in a horizontal path. This allows the user to feel greater stability which is important for older and physically challenged individuals. By varying the speed of the top vs. bottom ropes, different projectiles can be created. This can include complex projectiles formed by varying the speed of the motor(s) (located in the motor box 2836) throughout the range of motion of the exercise. The machine can also be programmed to alternate speeds between opposing motions to create greater or lesser perceived effort. For example, one may wish to exercise biceps lightly and triceps vigorously. In this case, a motion sensor determines the direction of travel of the conjoined flexible elements. Motor speed is automatically slowed during the upward movement, and sped up during the downward movement.

Furthermore, the flexible member(s) can be attached to a linkage which is rotatably mounted to the frame. The user then grasps a portion of the linkage and is thus allowed to exercise through a predetermined arc of motion. Alternatively, the flexible member(s) may be attached to a slide on a rail. The user then grasps the slide and is thus allowed to exercise through a predetermined range.

Recent studies have suggested that adding an element of instability, such as vibration, to an exercise produces improved results including greater strength, greater bone density, and increased weight loss. With each vibration the body is forced to perform reflexive muscle actions. Vibration machines, which are relatively known in the art, provide a platform on which a user stands and performs various exercises. Some of these machines can vary the frequency, amplitude, and direction of the vibrations.

The present invention can be adapted to enable the use of vibration during exercise. This involves use of an instability mechanism which adds an acceleration and deceleration component to the flexible member. The instability can include various combinations of frequency and displacement applied to the flexible member. Conjoined flexible members can utilize a common instability mechanism or individual instability mechanisms to create unique vibrations in various planes at the grip. The instability mechanism can take on many embodiments however in all cases it is designed to allow for the rapid acceleration and deceleration of the flexible member as it is being paid out by the driver. An example of a typical oscillation might be 2 mm of overall displacement at a frequency of 40 hz.

Figure 30A:
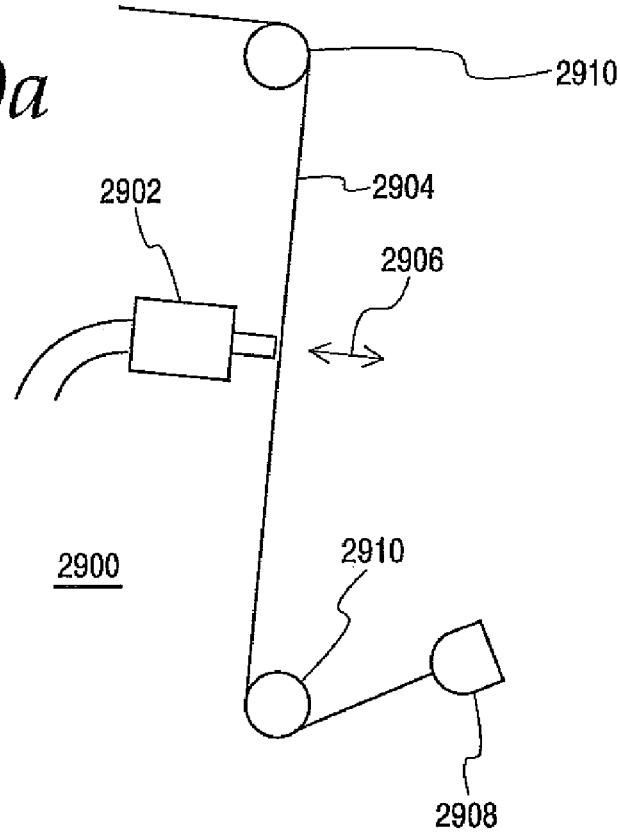
FIG. 30*a* is a side view of a means to provide oscillations according to the principles of the present invention.
Figure 30B:
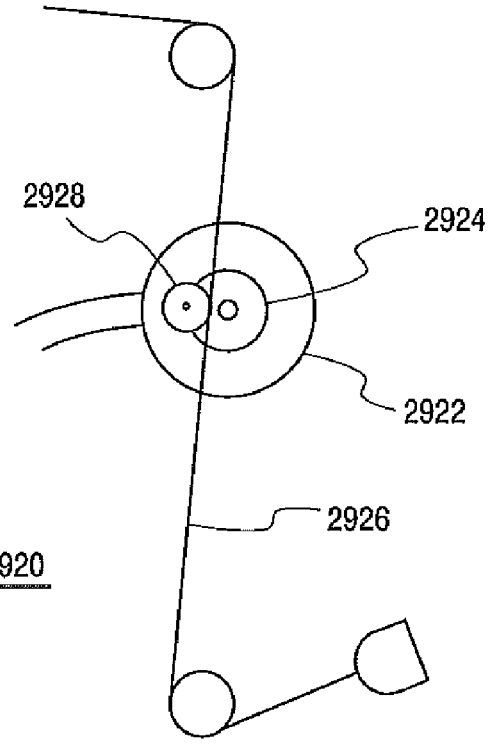
FIG. 30*b* is a side view of an alternate means to provide oscillations according to the principles of the present invention.

In one embodiment, a powerful drive motor is used which can be driven in such a manner as to produce the oscillations directly by rapidly accelerating and decelerating during rotation. Another embodiment involves displacing the flexible member at a point of travel between the driver and the grip. A solenoid, motor, or other mechanical device capable of rapid movement can be used. For example, and referring now to the oscillating system 2900 of FIG. 30*a*, a solenoid 2902 can be attached to mechanically interfere with the travel of the flexible member 2904 such as by operating in a direction tangent 2906 to the flexible member. Oscillations are then felt by the user during manipulation of the grips/handles 2908 through the pulleys 2910. Alternatively, and as the embodiment of the oscillating system 2920 in FIG. 30*b* illustrates, a motor 2922 or other mechanical device (such as a mechanical take-off from the drive motor) can be fitted with an offset hub 2924 and positioned to press against the flexible member 2926 and pulley 2928. As the motor rotates, the offset hub pushes and then releases pressure against the flexible member upon every revolution. Another embodiment involves vibrating the entire machine. This can be done, for example, by mounting a motor with an offset weight on the driveshaft to the frame of the machine. As the motor spins, the offset weight causes the entire frame to vibrate thereby adding a vibrating component to the grip.

In any event, the amplitude of the vibration can be varied by varying the throw of the solenoid, the amount of offset on the offset hub, changing the proximity of the devices to the flexible members, etc. The frequency can be adjusted by varying the rate of the solenoid, or varying the speed of the motor.

Referring back to FIG. 28, in order to measure the force application at each of the flexible members 2812, stain gauges 2816 can be installed at various points, such as at the pulley contact points. This force information can be displayed (e.g. "25 pounds") 2818 such as in the form of multiple bargraphs, numeric readouts, charts, etc. Force output can also be derived by measuring the energy dissipated by the speed controller during braking. For example, if a generator circuit is used for braking, the amount of current produced is proportional to the force output of the user.

Optical encoder(s) 2820, or the like, can be mounted on the spindles, pulleys, or other reference points to record the movement and direction of travel of the flexible members. This information can be translated to display range of motion, speed, etc. to the user. When this data is combined with the strain gauge data, force vs. displacement can be plotted and displayed for the user or therapist.

The user interface can include a so-called virtual coach which guides the user through a predetermined workout. Through voice commands or a display, the user will be instructed to perform specific strength moves. During these moves the machine can automatically alter the motor speed thereby changing the perceived resistance, count reps, record range of motion, record force applied during each rep, display comparisons of the present workout to previous workouts, and offer visual or audible coaching suggestions. For example, the display may graphically show an ideal force vs. displacement curve for a particular exercise which the user is encouraged to match. As the user performs the exercise, he can adjust his force output to match the profile on the display. The "virtual coach can be programmable by the user or a trainer/therapist to create an infinite variety of customized routines.

While particular embodiments of the invention have been shown and described, it will be obvious to those skilled in the art that changes and modifications may be made therein without departing from the invention in its broader aspects and therefore the purpose of the appended claims is to cover all such changes and modifications as fall within the true spirit and scope of the invention.

I claim:

1. An exercise apparatus, comprising:

a frame;

at least two drivers mounted on said frame and having at least one adjustable speed controller for controlling a constant predetermined speed; and at least one user engageable grip positioned to allow the exercise of opposing muscle groups, said grip being coupled to said drivers for controlled movement thereof through one-way clutching mechanisms whereby said mechanisms engage said drivers upon the user reaching said predetermined speed through actuation of said grip and maintains said predetermined speed during mechanism and driver engagement.

2. The exercise apparatus as defined in claim 1 wherein said drivers are driven by at least one a speed controlled motor.

3. The exercise apparatus as defined in claim 1 wherein said speed controller includes a braking mechanism.

4. The exercise apparatus as defined in claim 1 wherein said grip includes a free handle and cord that provides the user with a full range of motion during use.

5. The exercise apparatus as defined in claim 4 wherein said grip is located at user adjustable heights and/or widths.

6. The exercise apparatus as defined in claim 1 wherein said grip includes a handle on a rail, said grip further including a cord.

7. The exercise device as defined in claim 6 wherein said grip is located at user adjustable heights and/or widths.

8. The exercise apparatus as defined in claim 1 wherein said grip is a linkage rotatably mounted to the frame, said grip further including a cord.

9. The exercise apparatus as defined in claim 8 wherein said grip is located at user adjustable heights.

10. The exercise apparatus as defined in claim 1 wherein said grip includes a cord and said clutching mechanism includes a recoil for said cord.

11. The exercise apparatus as defined in claim 1 wherein said speed is user adjustable.

12. The exercise apparatus as defined in claim 1 wherein said speed is automatically adjusted based on the selected workout.

13. The exercise apparatus as defined in claim 1 further including a force measuring device for measuring the force output of the user.

14. The exercise apparatus as defined in claim 13 wherein said speed is automatically adjusted based on input from the force measuring device.

15. The exercise apparatus as defined in claim 13 wherein said force measuring device is a strain gauge.

16. The exercise apparatus as defined in claim 13 wherein said force measuring device derives force output of the user by measuring the energy dissipated by said speed controller.

17. The exercise apparatus as defined in claim 1 further including a displacement measuring device to measure the displacement of the grip.

18. The exercise apparatus as defined in claim 17 wherein said speed is automatically adjusted based on input from the displacement measuring device.

19. The exercise apparatus as defined in claim 1 including display means for displaying at least one of speed, force applied, range of motion, number of repetitions, and past performance information.

20. The exercise apparatus as defined in claim 1 including display means capable of displaying an optimal force vs. displacement chart along with an actual force vs. displacement chart.

21. The exercise apparatus as defined in claim 1 including display means capable of displaying an optimal force output with an actual force output.

22. The exercise apparatus as defined in claim 1 including display (or voice) means capable of displaying user instructions including which exercise to perform.

23. The exercise apparatus as defined in claim 1 including means for adjusting grip speed during exercise to vary the perceived effort during a stroke.

24. The exercise apparatus as defined in claim 23 where speed is varied by changing motor speed.

25. The exercise apparatus as defined in claim 23 where said driver includes a conical shaped spindle.

26. The exercise apparatus as defined in claim 23 where said driver includes a flat belt concentrically wrapped around a spindle.

27. The exercise apparatus as defined in claim 13 including means for speeding up the driver when a predetermined force is exceeded.

28. The exercise apparatus as defined in claim 1 including means for providing different speeds for each of the at least two drivers.

29. The exercise apparatus as defined in claim 28 wherein the different speeds are determined in response to input from said displacement measuring device.

30. The exercise apparatus as defined in claim 28 wherein said means involves using multiple motors.

31. The exercise apparatus as defined in claim 28 wherein said means involves using spindles with different diameters mounted on the drivers.

32. The exercise apparatus as defined in claim 1 including means for varying the speed of the at least two grips throughout the range of motion to create complex projectile paths of the grips.

33. The exercise apparatus as defined in claim 1 including instability means for causing the grips to vibrate.

34. The exercise apparatus as defined in claim 33 wherein the frequency and/or magnitude of said vibration is user adjustable.

35. The exercise apparatus as defined in claim 33 wherein the frequency and/or magnitude of said vibration is machine adjustable.

* * * * *